US011660516B2

(12) United States Patent
McGauley

(10) Patent No.: US 11,660,516 B2
(45) Date of Patent: May 30, 2023

(54) SPORT TRAINING APPARATUS AND METHOD

(71) Applicant: Tyadg McGauley, Wilcox (CA)

(72) Inventor: Tyadg McGauley, Wilcox (CA)

( * ) Notice: Subject to any disclaimer, the term of this patent is extended or adjusted under 35 U.S.C. 154(b) by 80 days.

(21) Appl. No.: 16/969,995

(22) PCT Filed: Feb. 8, 2019

(86) PCT No.: PCT/CA2019/050165

§ 371 (c)(1),
(2) Date: Aug. 14, 2020

(87) PCT Pub. No.: WO2019/157590

PCT Pub. Date: Aug. 22, 2019

(65) Prior Publication Data

US 2021/0101060 A1 Apr. 8, 2021

Related U.S. Application Data

(60) Provisional application No. 62/631,147, filed on Feb. 15, 2018.

(51) Int. Cl.
*A63B 69/36* (2006.01)
*A63B 69/00* (2006.01)

(52) U.S. Cl.
CPC ..... *A63B 69/002* (2013.01); *A63B 69/0024* (2013.01); *A63B 2225/09* (2013.01)

(58) Field of Classification Search
CPC ..... A63B 69/002; A63B 69/0024; A63B 2225/09; A63B 71/03; A63B 2102/22; A63B 2102/24; A63B 2225/093; A63B 2243/0025
USPC ..... 473/446
See application file for complete search history.

(56) References Cited

U.S. PATENT DOCUMENTS 1,206,194 A * 11/1916 Gisserg et al. ..... A63F 7/027 273/118 R
4,147,347 A * 4/1979 Angove ..... A63B 67/002 273/127 B
5,226,821 A * 7/1993 Murphy ..... A63B 69/0026 434/247

(Continued)

FOREIGN PATENT DOCUMENTS

CA 2312671 1/2001
CA 2715697 3/2012

OTHER PUBLICATIONS

International Search Report and Written Opinion of the International Search Authority for International Patent Application No. PCT/CA2019/050165 (dated Apr. 29, 2019).

(Continued)

*Primary Examiner* — Nini F Legesse
(74) *Attorney, Agent, or Firm* — Robinson IP Law, PLLC

(57) ABSTRACT

A sport training apparatus, such as for hockey or soccer (e.g. football) having an elongated base member and one or more stick members coupled to the elongated base member. One or more support members extend from under the elongated base member to rest on a training surface. A projectile, such as a puck, may pass under the elongated base member. The stick members may have an angle from about 0-degrees to about 180-degrees with respect to the elongated base member.

39 Claims, 39 Drawing Sheets

(56) References Cited

U.S. PATENT DOCUMENTS

| | | | | |
|---|---|---|---|---|
| 6,165,084 | A * | 12/2000 | Cranston | A63B 69/0026 280/818 |
| 8,357,061 | B2 * | 1/2013 | Quinn | A63B 59/70 473/422 |
| 8,783,689 | B1 * | 7/2014 | Copenhaver | G09B 19/0038 273/359 |
| 2003/0096666 | A1 * | 5/2003 | Zielinski | A63B 71/00 473/446 |
| 2012/0083367 | A1 * | 4/2012 | Quinn | A63B 5/22 473/446 |
| 2017/0095717 | A1 * | 4/2017 | Simonov | G09B 19/0038 |
| 2018/0339210 | A1 * | 11/2018 | Linneman | A63B 69/0026 |
| 2019/0224547 | A1 * | 7/2019 | Theriault | A63B 59/70 |
| 2020/0353338 | A1 * | 11/2020 | Cranston | A63B 59/70 |

OTHER PUBLICATIONS

International Preliminary Report on Patentability for International Patent Application No. PCT/CA2019/050165 (dated Aug. 18, 2020).
Power Edge Pro (available at www.poweredgepro.com).

* cited by examiner

SPORT TRAINING APPARATUS AND METHOD

FIELD

This invention is in the field of sports training apparatuses and methods, and more specifically to hockey and/or soccer (e.g. football) training apparatuses and methods.

BACKGROUND

Canadian patent application nos. 2,715,697 and 2,762,626, filed Sep. 30, 2010 and Dec. 22, 2011 respectively, discloses a training apparatus for use on a training surface. The training apparatus includes a sport-projectile stopping member and an elongated body substantially transverse to the sport-projectile stopping member. The elongated body has a first section, a second section, and a transition section between the first and second sections. A portion of the first section is positioned on the sport-projectile stopping member, and the first section is sized such that the sport-projection stopping member, the first section, the training surface and the transition section define an orifice through which a sport-projectile can pass through.

Canadian patent application no. 2,312,671, filed Jun. 28, 2000, discloses a hockey training device comprising a frame with skate-like and hockey stick-like members attached thereto, simulating an opposing player. This training device is intended to assist the novice hockey player in developing the skills associated with maneuvering the hockey puck around and/or through an opponent, and forces the novice to concentrate on the triangle presented by the skates and hockey stick of the opponent. The device consists of a frame supporting two downwardly disposed legs having skate-like elements attached, and a third leg having a stick-like element attached. The skate-like elements and stick-like elements have coplanar lower edges so that the entire device may be placed on the ice, resting on these edges. The frame may be weighted, and drag-inducing spikes may be incorporated into the skate-like elements to affect the motion of the device on the ice.

U.S. Pat. No. 5,226,821, filed Feb. 12, 1992, discloses a hockey training device that includes a base having a first end and a second end, a side having a bottom end and a top end, a telescoping connector, and at least one locating surface mounted on the hockey training device to support the hockey training device above a playing surface. The bottom end of the side is pivotally connected to the first end of the base and the telescoping connector is pivotally connected to the second end of the base and the top end of the side, such that the base, side and telescoping connector form a triangle.

SUMMARY OF THE INVENTION

Any and all aspects as described herein, individually or in any combination consistent to one of skill in the art.

According to an aspect, a sport training apparatus may comprise: an elongated base member; at least one stick member coupled to the elongated base member; at least one support member extending from the elongated base member to rest on a training surface for permitting a passage of a projectile under the elongated base member; and the at least one stick member has an angle from about 0-degrees to about 180-degrees with respect to the elongated base member. The elongated base member may have a first end and a second end. A first slot located on the first end may receive a first set of the at least one stick member and a second slot located on the second end may receive a second set of the at least one stick member. The first set may be a pair of stick members and the second set may be a single stick member. The first set may be a pair of stick members and the second set may be a pair of stick members.

Each pair of the stick members may be angled toward a center of the elongated base member or away from the center of the elongated base member. The angle may be an obtuse angle or an acute angle. The pair of stick members may be about 180-degrees with respect to each other. Both the first set of the at least one stick member and the second set of the at least one stick member may have a same value of the angle.

The at least one stick member may comprise an insertion member for inserting into the first slot or the second slot of the base member. The at least one stick member may further comprises a shaft coupled to the insertion member forming the angle. The angle may be approximately 135-degrees from each of the pair of stick members.

The at least one stick member may comprise a horizontal leg coupled at an end to the shaft and another end coupled to a bow member connecting with a toe member that contacts the training surface. The horizontal leg may have an angle of approximately 90-degrees with respect to the shaft. The bow member may extend upward from the toe member between approximately 20-degrees to approximately 30-degrees.

The at least one support member may comprises a pair of support members. One of the pair of support members may be located under the first end and the other one of the pair of support members may be located under the second end of the elongate base member. The at least one support member may be triangular-shaped or disc-shaped.

The elongated base member may comprise an extension member coupled to the elongated base member to extend a length of the elongated base member in a longitudinal direction. The extension member may be an elongated telescoping body sized to be received in the elongated base member. The elongated base member may comprise a wider portion that tapers toward the first end; at least a portion of the wider portion rests on the training surface for prohibiting the projectile to pass.

DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION

Figure 1:
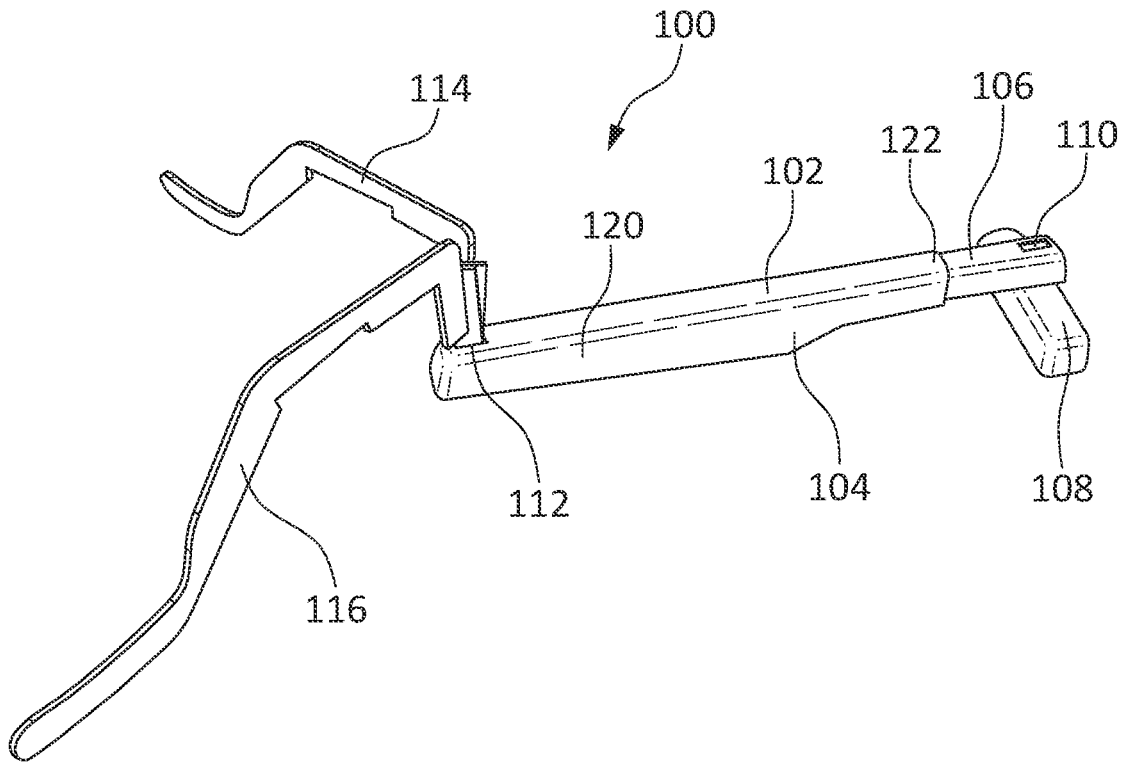
FIG. 1 is a photograph of a left-side perspective view of a training device according to one aspect.

The refinement of professional and/or amateur sports has become increasingly competitive and complicated necessitating improvements in training equipment. In particular, sports such as hockey, soccer (e.g. football), ringette, and other sports require improved training and understanding. Most of these sports are typically trained on big, open playing fields and/or train skills in isolation. However, these sports (among others) are games of obstacles, such as skates, sticks, nets, and opposing players. Obstacle-based training may improve and/or refine a player's skill by requiring the player to accurately place the sport projective through gaps of the obstacle(s), around the obstacle(s), and the player must avoid the obstacle(s). According to the aspects described herein, obstacle-based training may provide players with functional skills throughout practice and training sessions.

With reference to FIGS. 1 to 9, a training device 100 may comprise an elongate base support 102 that may rest on a playing surface, such as ice for ice hockey, a field, and/or gymnasium floor. The elongate base support 102 may generally be tubular and open at one end 122 to receive a telescoping member 106. The elongate base support 102 may comprise a horizontally wider and/or vertically wider end 120. The wider portion 120 may taper 104 towards the end 122 where the telescoping member 106 may be received. The wider portion 120 may have increased width in order to extend a distance a player must jump over the training device 100. In other aspects, the wider portion 120 may prohibit a projectile (not shown), such as a ball, puck, etc. from passing under the elongate base support 102.

The telescoping member 106 may comprise an elongate member sized in such a manner as to be received by the elongate base support 102. A support 108 may be coupled generally perpendicular to the telescoping member 106. At least a portion of the support 108 may rest on the playing surface in order to hold the telescoping member 106 and elongate base support 102 generally parallel to the playing surface. In this aspect, the support 108 may be located at or near the end opposite to the end received by the elongate base support 102. The support 108 may resemble a rectangular prism or in other aspects may comprise one or more protrusions to contact the playing surface. In other aspects, the protrusions may be placed far enough apart to permit the projectile to pass under the support 108.

In some aspects, the telescoping member 106 may be narrower than the wider portion 120 of the elongate base support 102 in order to permit passage of the projectile thereunder. Therefore, extending the telescoping member 106 may increase a length where the projectile may pass in addition to providing a longer obstacle for the player to avoid/jump.

The elongate base support 102 and/or the telescoping member 106 may comprise one or more slots 110, 112 for receiving one or more stick members 114, 116. In this aspect, the elongate base support 102 comprises a single the slot 110 at the end 122 opposite to the telescoping member 106 and a single slot 112 at or near the support 108 of the telescoping member 106. Also in this aspect, the slots 110, 112 may receive two stick members 114, 116 as further described in detail below.

The stick members 114, 116 may be mirror images of each other and therefore the description herein will only describe the stick member 116. The elements and features of stick member 114 may be identical (but in mirror image) and provide the same benefits as the stick member 116 described. In this aspect, the stick member 116 may generally comprise a head of a hockey stick. The stick member 116 may comprise a horizontal toe 602 configured to rest on the playing surface. The toe 602 may be coupled to a bow 604 that extends upward from the toe 602 at approximately 20-degrees to approximately 30-degrees. The upper end of the bow 604 may be coupled to a generally horizontal leg 606 (e.g. the angle between the bow 604 and the leg 606 may be approximately 60-degrees). The opposite end of the horizontal leg 606 may be coupled to a shaft 608. The horizontal leg 606 may have an angle of approximately 90-degrees to the shaft 608 in order to facilitate coupling of the stick members 114, 116 to the elongate base member 102.

Figure 8:
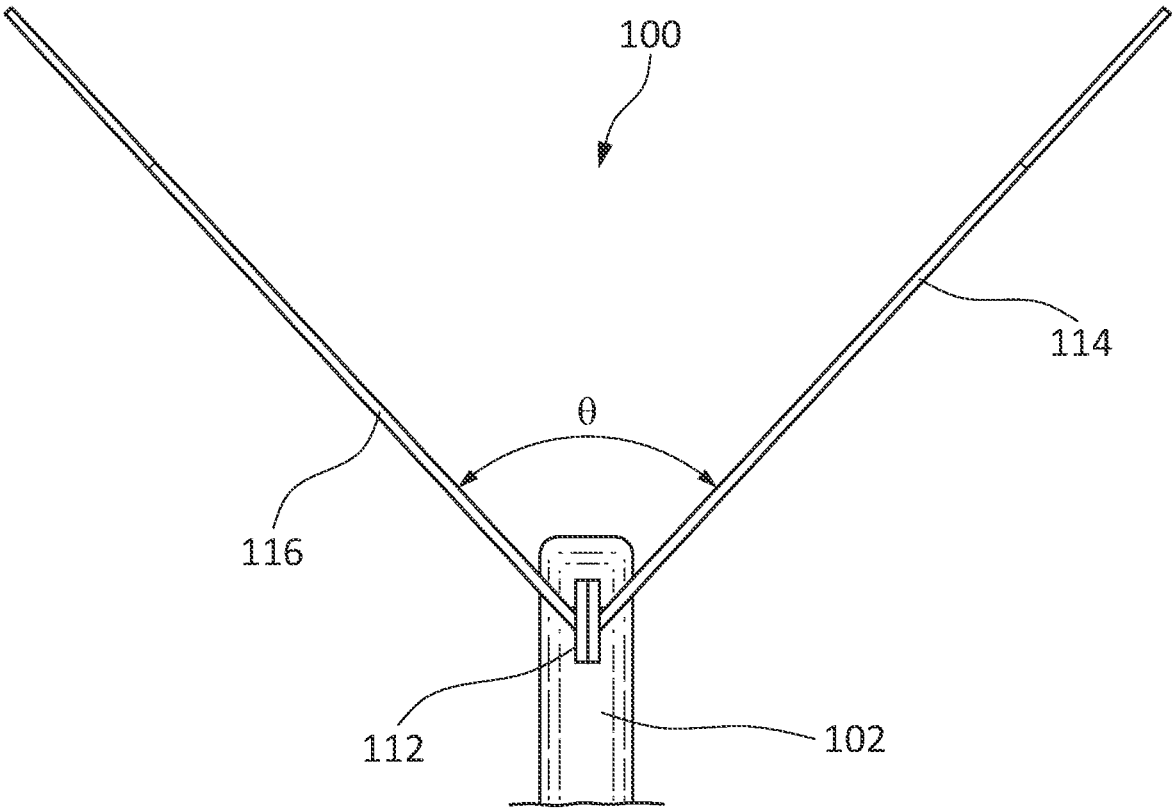
FIG. 8 is a photograph of a top view of the left end of the training device of FIG. 1 with both sticks inserted.
Figure 9:
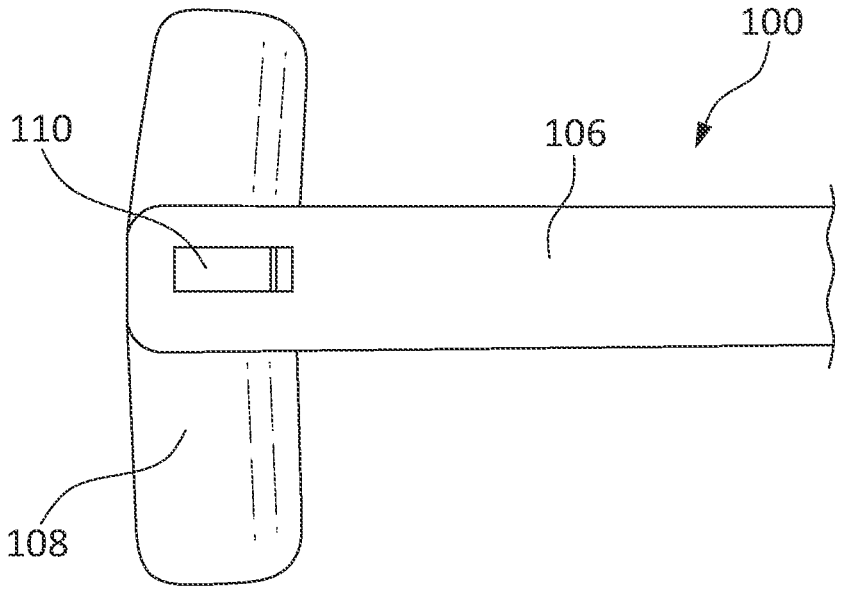
FIG. 9 is a photograph of a top view of the right end of the training device of FIG. 1.

The shaft 608 may be coupled along one edge to an insertion member 610. The insertion member 610 may be sized in order for two insertion members 610 to fit within the slots 110, 112. In this aspect, the shaft 608 may be coupled to the insertion member 610 at an angle of approximately 45-degrees. Therefore, when the insertion member 610 of two sticks 114, 116 are placed within one of the slots 110, 112, an angle θ may be approximately 90-degrees between the two sticks 114, 116 as shown in FIG. 8. When the stick 114, 116 is inserted into the slots 110, 112, the toe 602 may rest on the playing surface in order to provide an obstacle (e.g. block the projectile).

Figure 10:
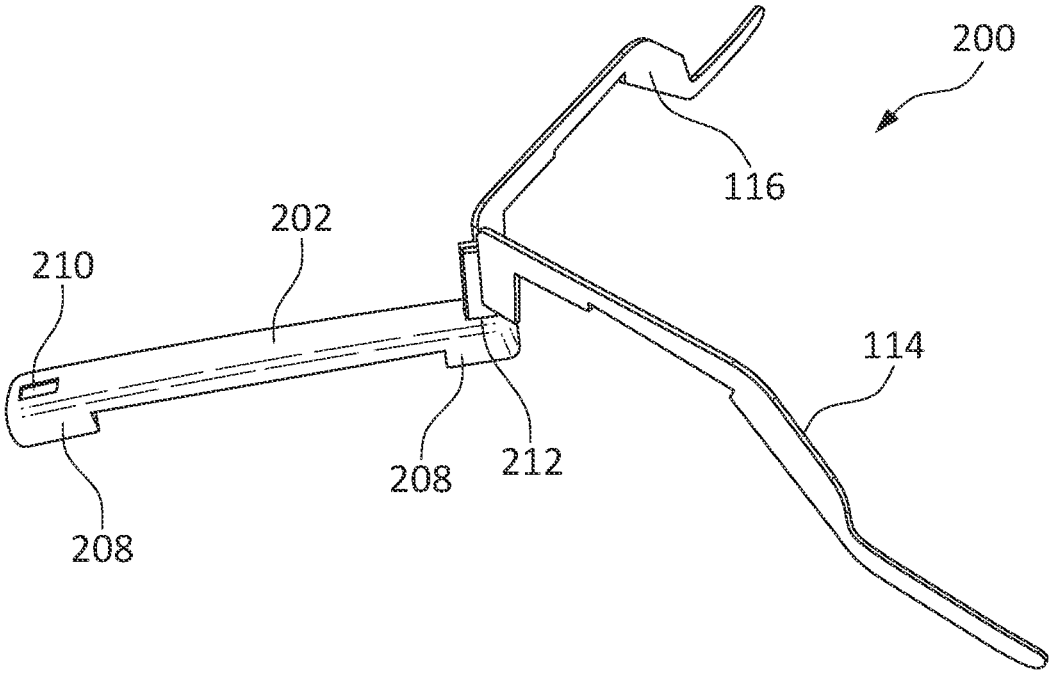
FIG. 10 is a photograph of a right-side perspective view of a training device according to another aspect.
Figure 11:
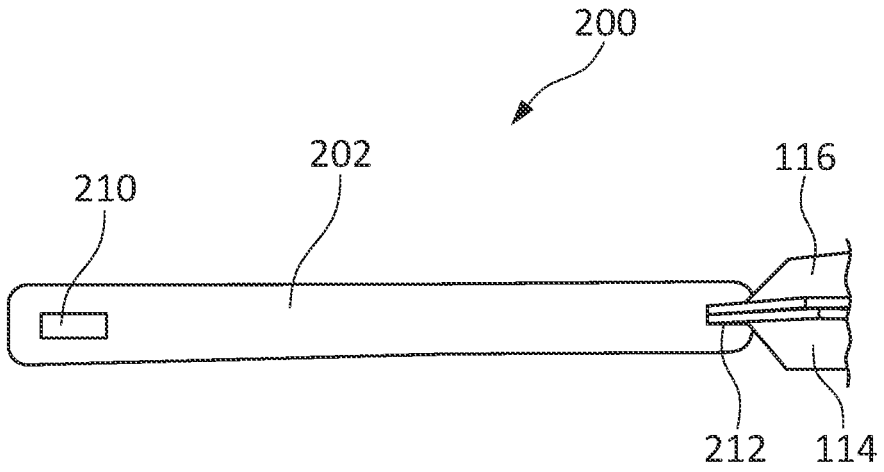
FIG. 11 is a photograph of a top view of a support portion of the training device of FIG. 10.

Turning now to FIGS. 10 to 11, a non-telescoping training device 200 is presented. The non-telescoping training device 200 may comprise short, elongate base 202 having a pair of supports 208 for resting on the playing surface. The supports 208 raise the elongate base 202 above the playing surface and may permit the projectile from passing thereunder. Similar to the training device 100 of FIGS. 1 to 11, the elongate base 202 may comprise at least one slot 210, 212 for receiving one or more of the sticks 114, 116 therein.

Figure 2:
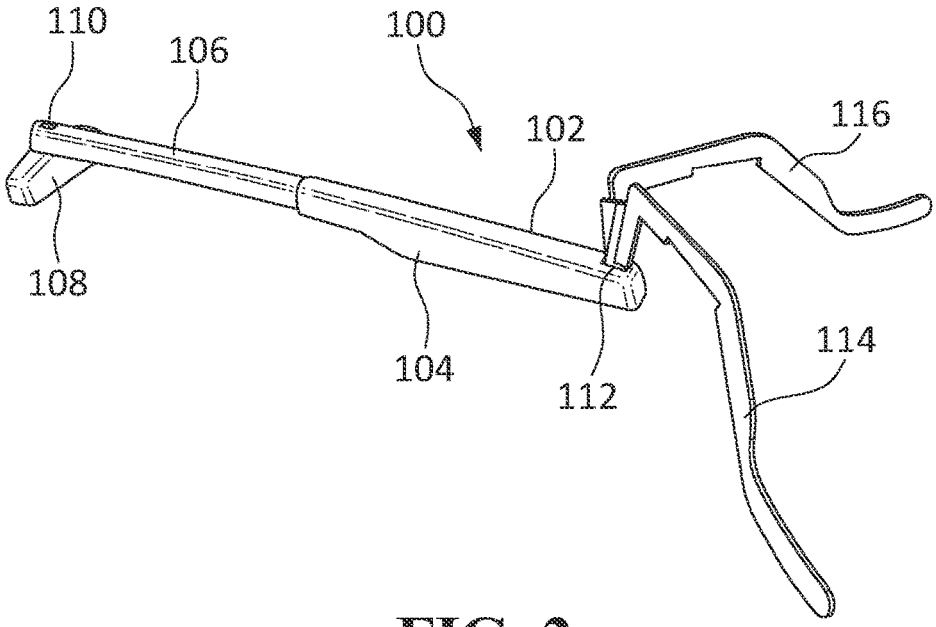
FIG. 2 is a photograph of a right-side perspective view of the training device of FIG. 1.
Figure 3:
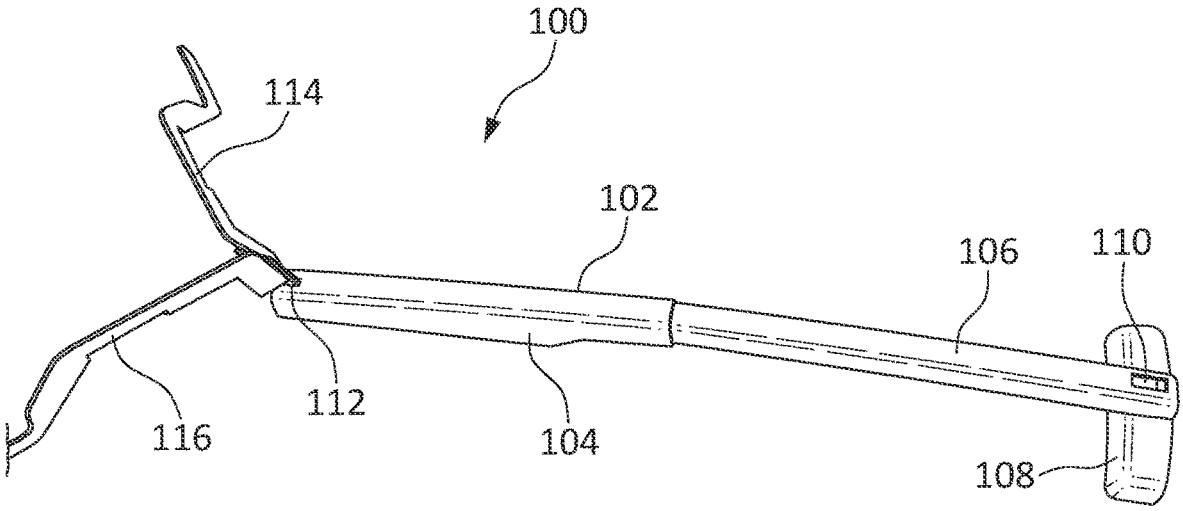
FIG. 3 is a photograph of a top perspective view of the training device of FIG. 1.
Figure 4:
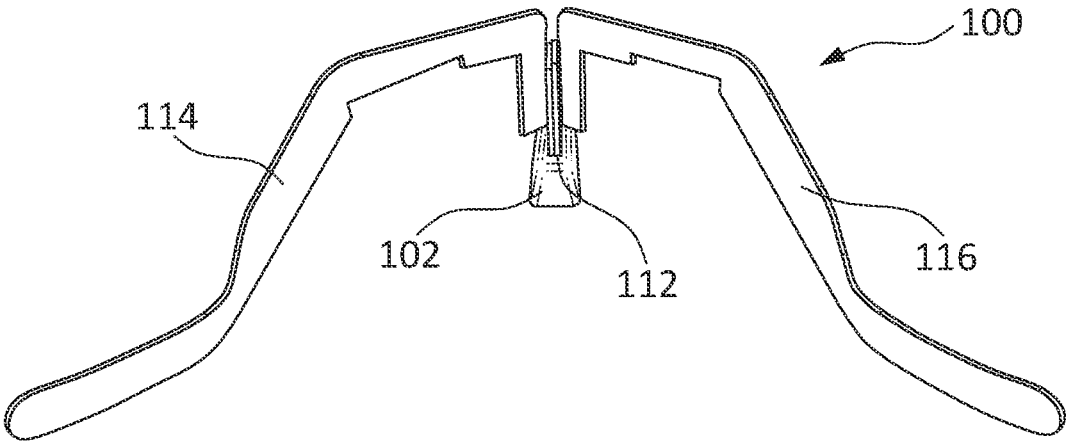
FIG. 4 is a photograph of a left-end view of the training device of FIG. 1.
Figure 5:
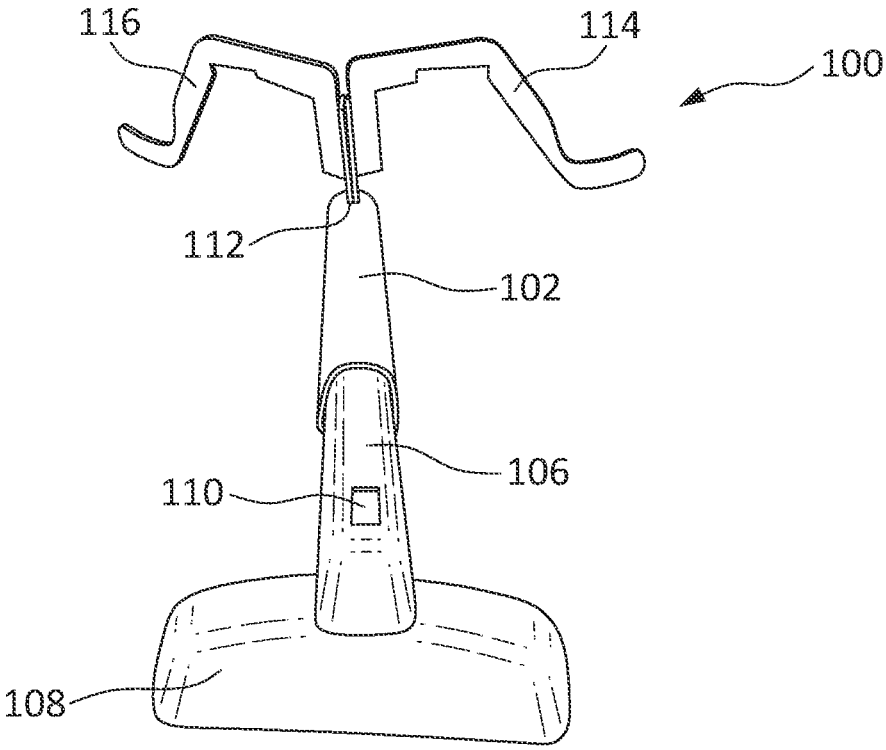
FIG. 5 is a photograph of a right-end view of the training device of FIG. 1.
Figure 6:
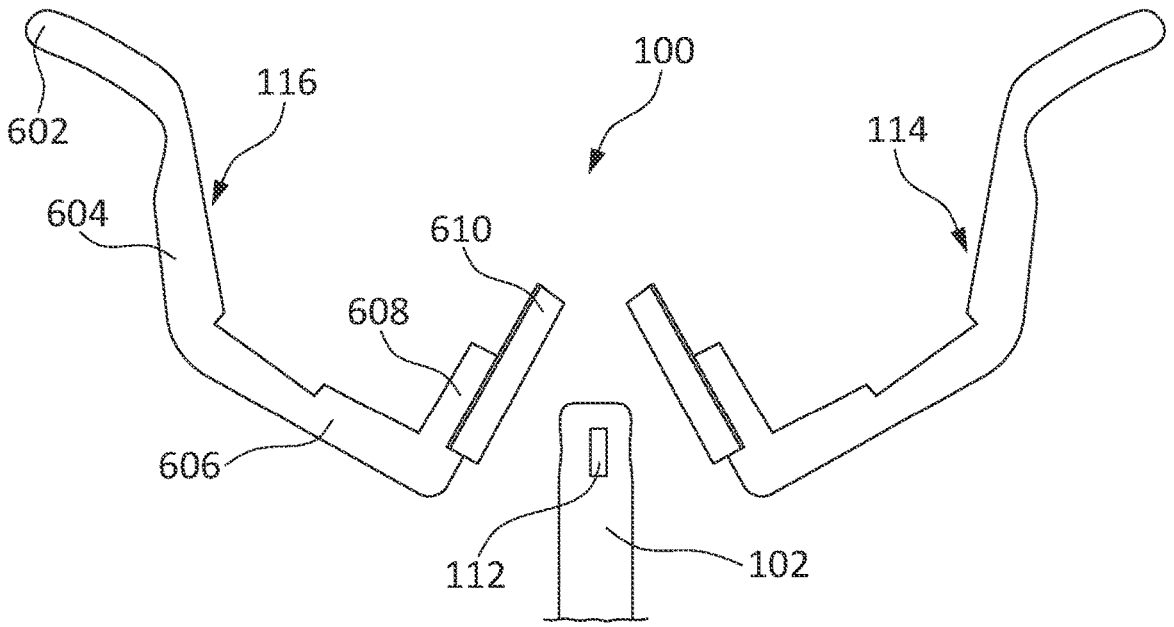
FIG. 6 is a photograph of a top view of a left end of the training device of FIG. 1 with a pair of sticks removed.
Figure 7:
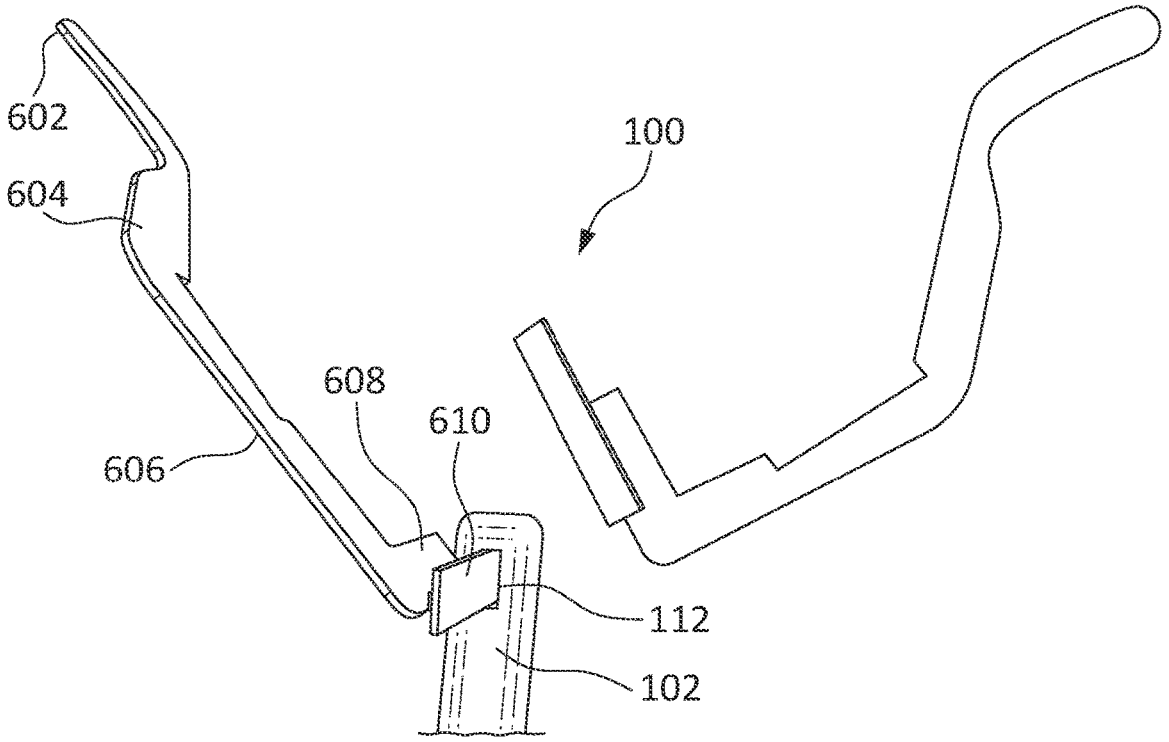
FIG. 7 is a photograph of a top view of the left end of the training device of FIG. 1 with one stick inserted.
Figure 13:
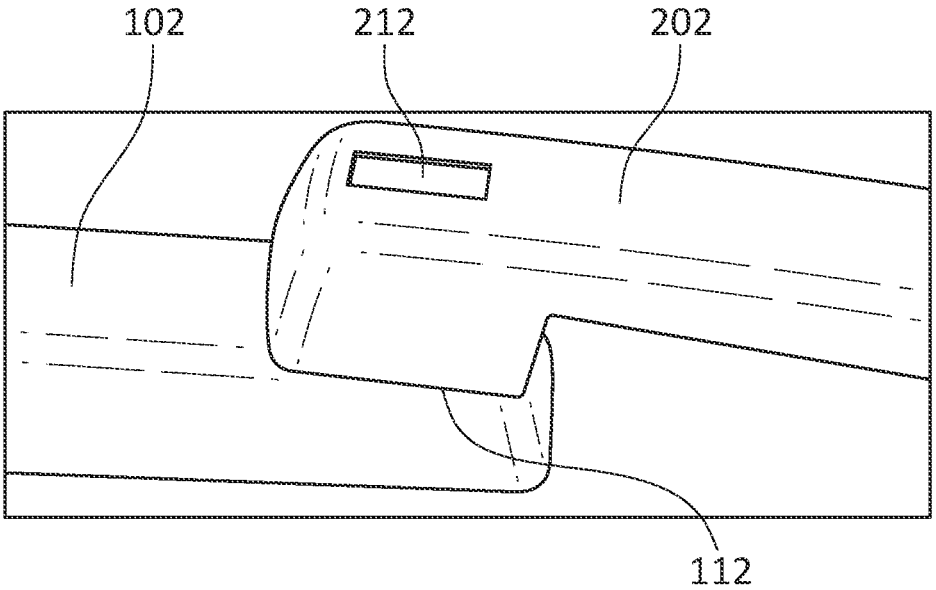
FIG. 13 is a photograph of a side perspective view of the training device of FIG. 1 used in conjunction with the training device of FIG. 10.
Figure 14:
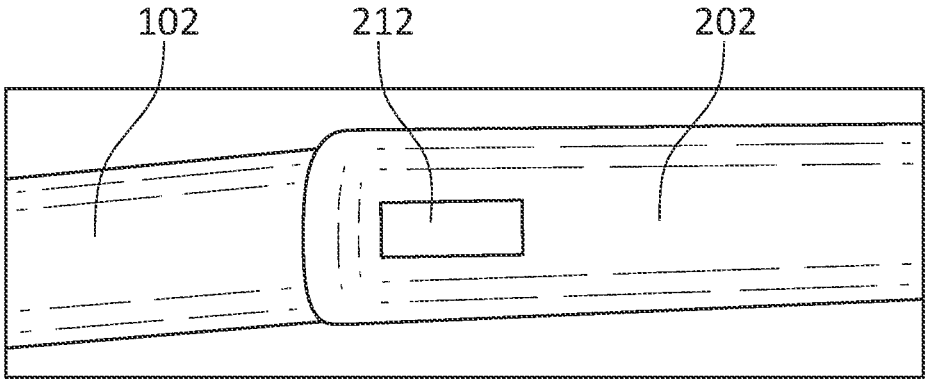
FIG. 14 is a photograph of a top view of the training device of FIG. 1 used in conjunction with the training device of FIG. 10.

Returning to FIG. 1, a substantial portion of the telescoping member 106 may be slid within the elongate base support 102. As shown in FIGS. 2 and 3, the telescoping member 106 may be extended from the elongate base support 102 providing approximately double a length of the training device 100. According to another aspect, if additional length may be required, the non-telescoping training device 200 may be used to further extend the training device 100 as shown in FIGS. 12 to 14 as described below.

Figure 12:
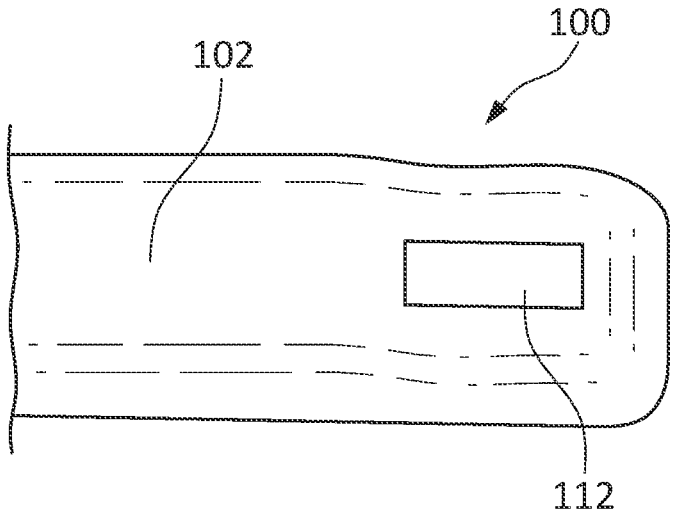
FIG. 12 is a photograph of a top view of one end of the training device of FIG. 10

The end of the training device 100 to be extended is shown in FIG. 12. In this aspect, the slot 112 on the elongate base support 102 is shown, but this aspect may apply equally well to the slot 110 on the telescoping member 106. One end of the elongate base 202 of the non-telescoping device 200 may be placed on top of one end of the elongate base support 102 as shown in FIG. 13. As may be observed in this aspect, the elongate base 202 may be raised by the elongate base support 102. The slot 212 of the non-telescoping training device 200 may be aligned with the slot 112 of the telescoping training device 100 and a fastener (not shown), such as the insertion member 610, may be placed through both slots 112 and 212.

Figure 15:
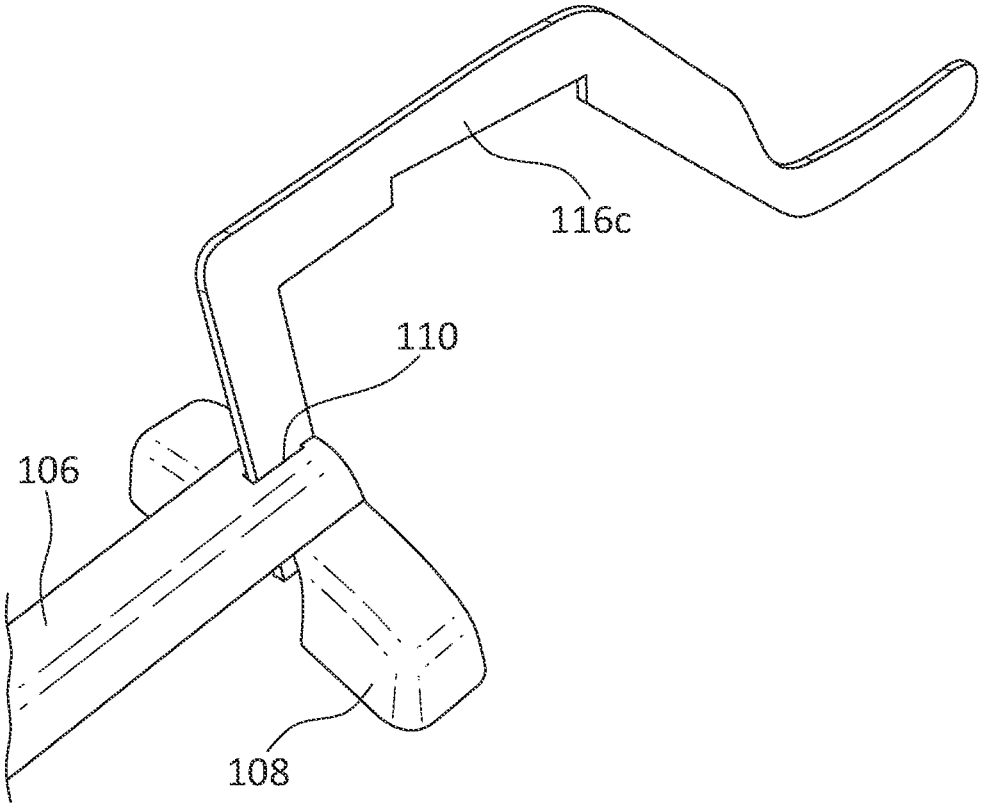
FIG. 15 is a photograph of a rear perspective view of the support of the training device of FIG. 1 demonstrating a central stick member.
Figure 26:
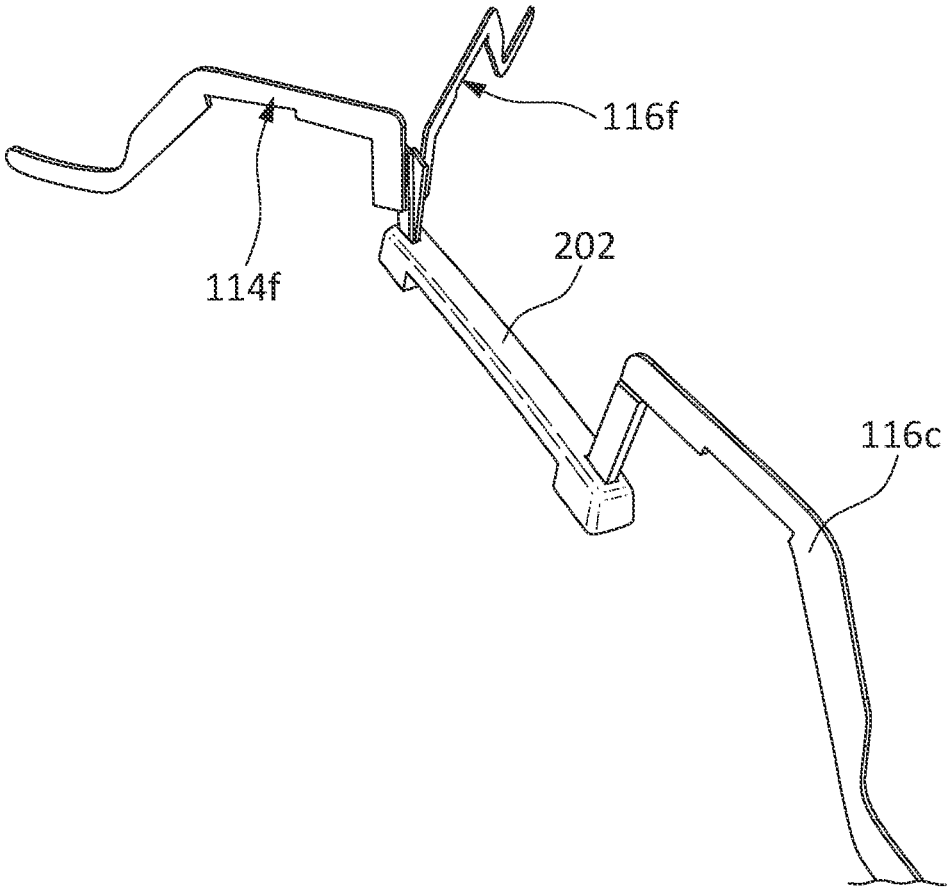
FIG. 26 is a top perspective view of the training device of FIG. 10 demonstrating the "lobster" configuration.

Turning to FIG. 15, there is presented another aspect where a central stick member 116*c* may be placed within the slot 110. Although the FIG. 15 presents the central stick member 116*c* placed in slot 110 of the telescoping member 106, the central stick member 116*c* may be placed in any of the slots 110, 112, 210, 212 of the training device 100 or the training device 200. For example, as further shown in FIG. 26, the central stick member 116*c* is placed on one end of the elongate base 202. At the opposite end, the pair of stick members 114*f*, 116*f* may form a generally "lobster" configuration further described with reference to FIG. 22 below.

Figure 16:
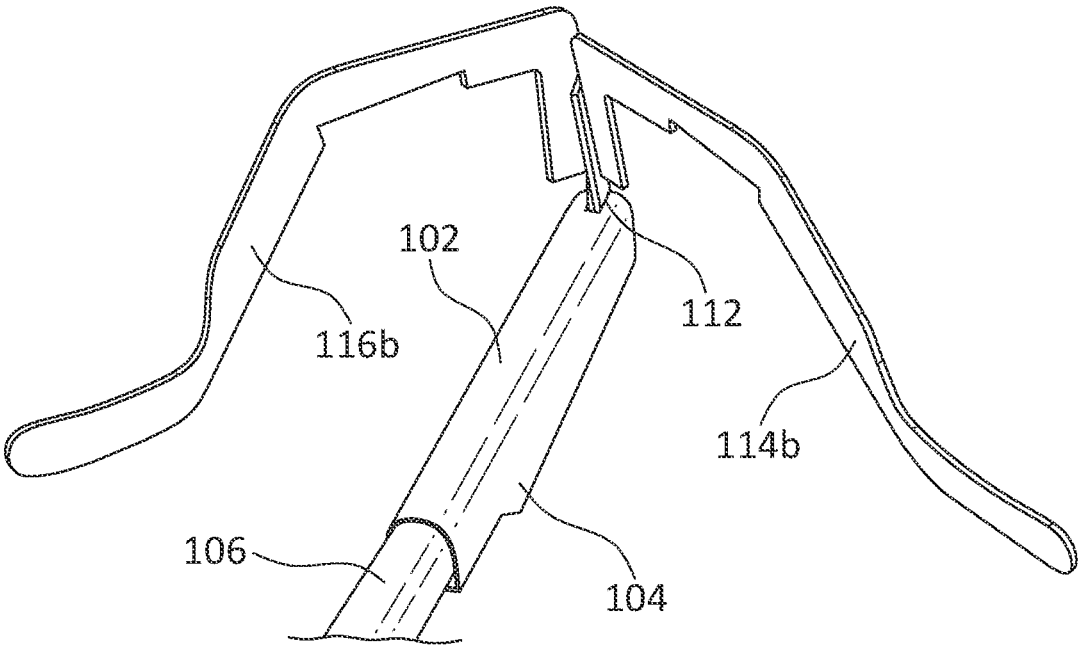
FIG. 16 is a photograph of a perspective view of the elongate base support of the training device of FIG. 1 demonstrating swept back stick members.

Although the aspects herein demonstrate the stick members 114, 116 as forward swept, another aspect, presented in FIG. 16 demonstrates a pair of backward swept stick members 114*b*, 116*b*. The use of the term forward swept in this context means that the stick members 114, 116 extend away and past an end from the main body of the training device 100, 200. For example, each respective stick member 114, 116 may extends past an end of the elongate base 202, telescoping member 106, or elongate base 202 respectively and forms an obtuse angle with the respective main body (e.g. elongate base 202, telescoping member 106, or elongate base 202) when viewed from above. The term backward swept in this context means that the stick members 114*b*, 116*b* do not extend past the end of the main body of the training device 100, 200. For example, each respective stick member 114*b*, 116*b* does not extend past an end of the elongate base 202, telescoping member 106, or elongate base 202 respectively and forms an acute angle with the respective main body (e.g. elongate base 202, telescoping member 106, or elongate base 202) when viewed from above.

Figure 17:
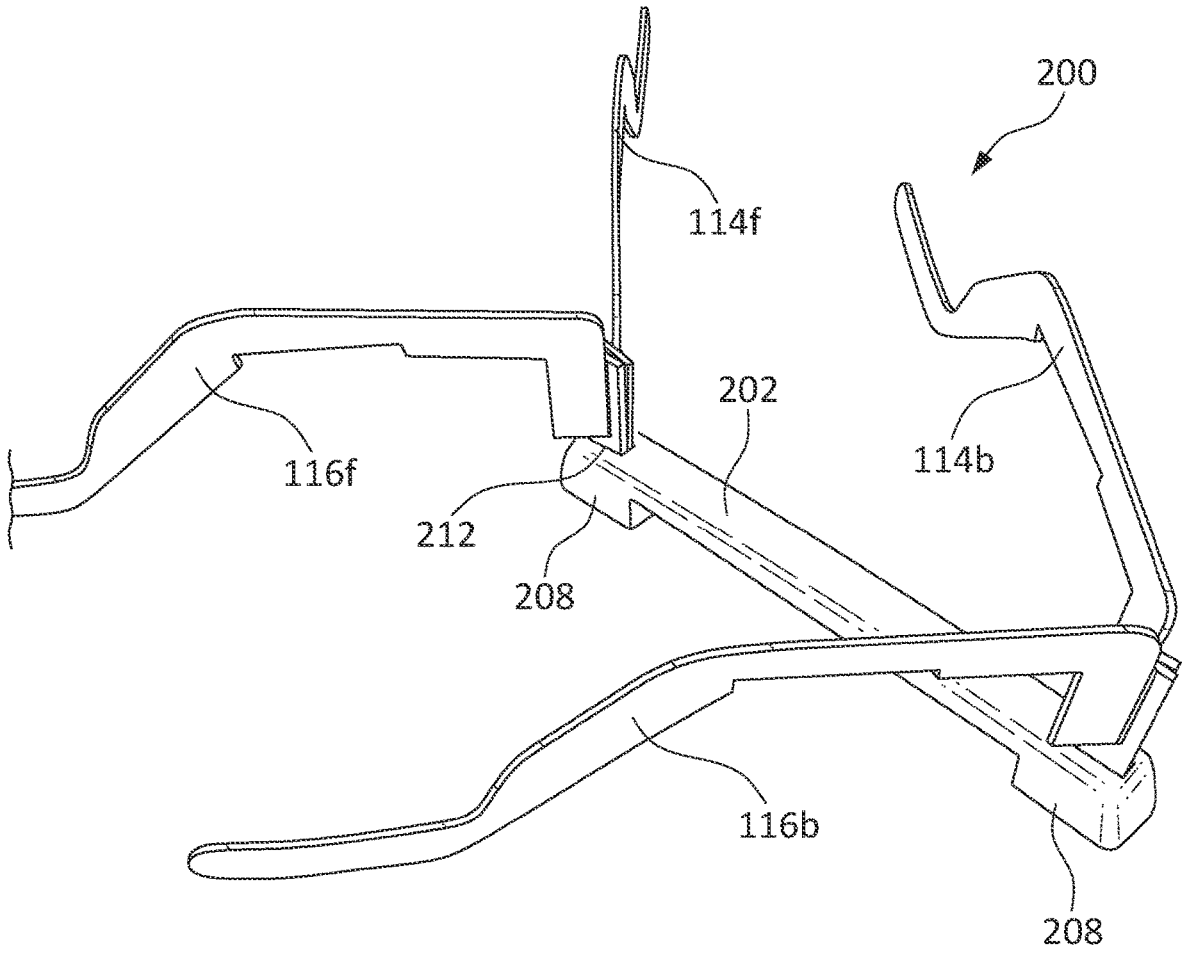
FIG. 17 is a photograph of a perspective view of the training device of FIG. 10 demonstrating a pair of swept back stick members and a pair of swept forward stick members on opposite ends respectively.

Turning to FIG. 17, a pair of forward swept stick members 114*f*, 116*f* are on one end of elongate base 202 of the training device 200 and a pair of backward swept stick members 114*b*, 116*b* are on the other end of the elongate base 202 of the training device 200. Although FIG. 17 presents this configuration on the training device 200, the configuration may also be applied to the telescoping training device 100 of FIG. 1.

Figure 18:
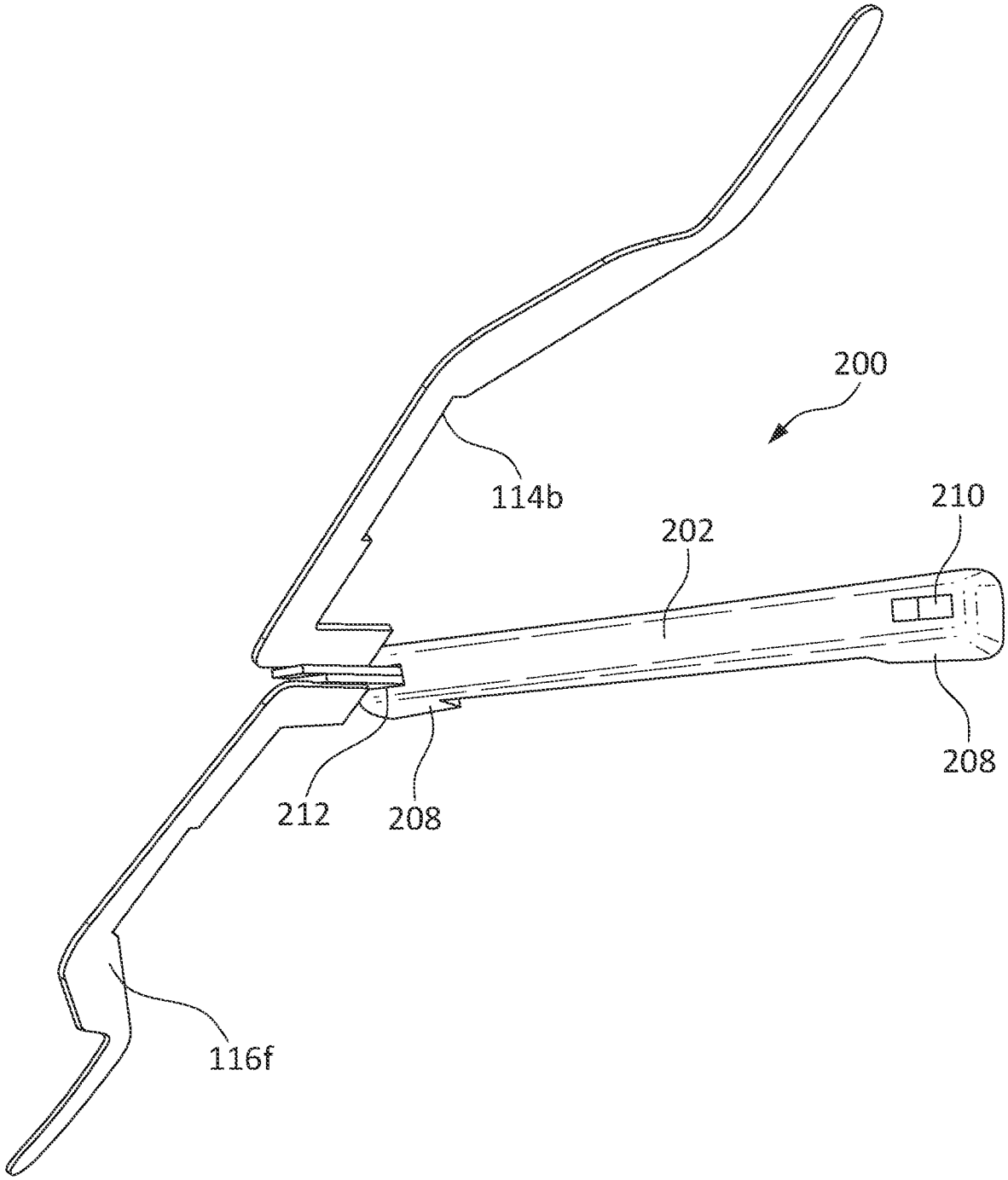
FIG. 18 is a photograph of a perspective view of the training device of FIG. 10 demonstrating a swept back and swept forward stick member on the same end.

In some aspects, such as shown in FIG. 18, the forward swept stick member 116*f* may be used in conjunction with the backward swept stick member 114*f* (or vice versa, e.g. 116*b* may be used in conjunction with 114*f*). This configuration generally aligns the stick member 116*f* and stick member 114*b* to form a line segment across an end of the main body (e.g. in this case the elongate base 202). This configuration may equally apply to the telescoping training device 100 of FIG. 1.

Figure 19:
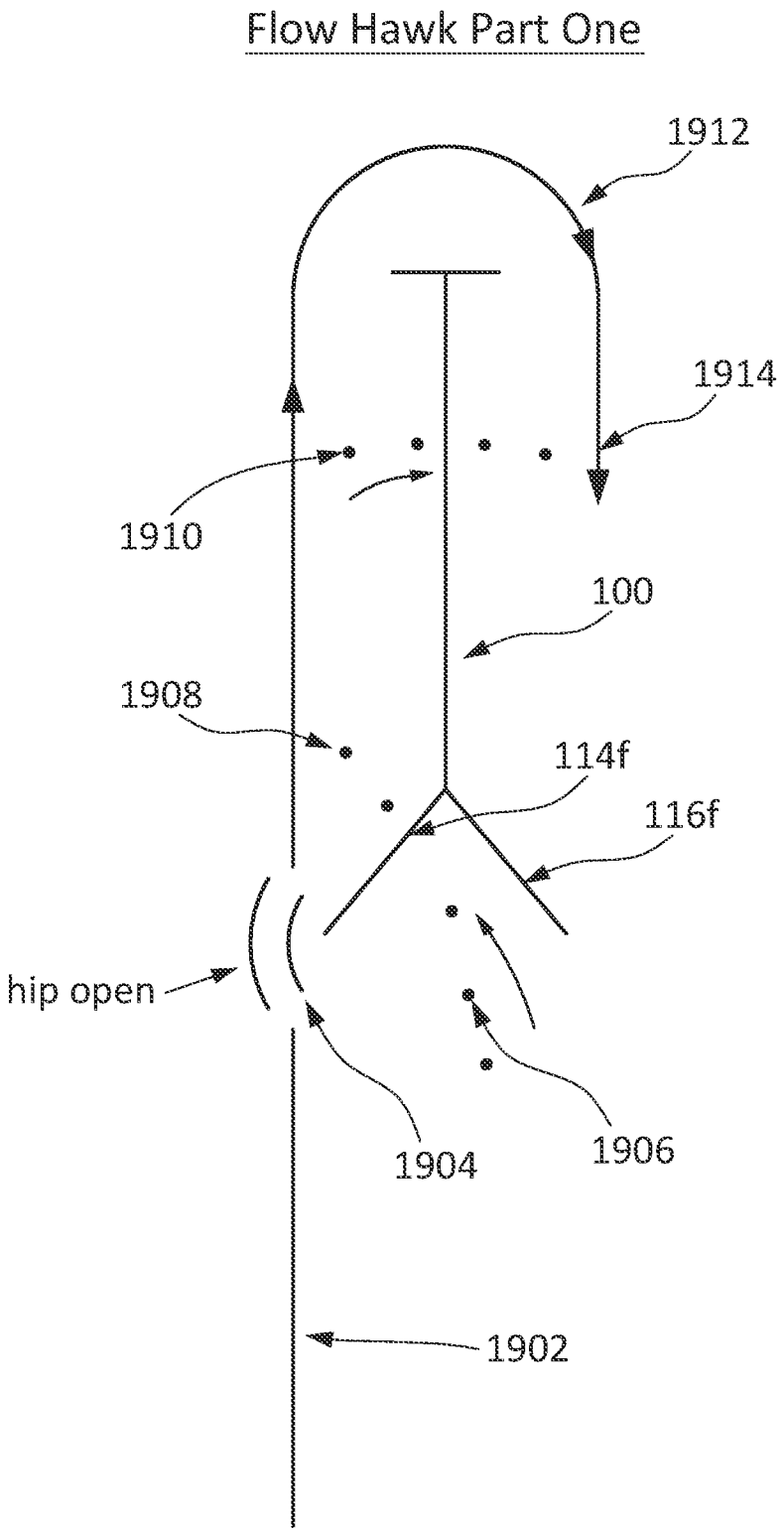
FIGS. 19 to 21 are overhead view sketches demonstrating three example drill patterns using the training device of FIG. 1.
Figure 20:
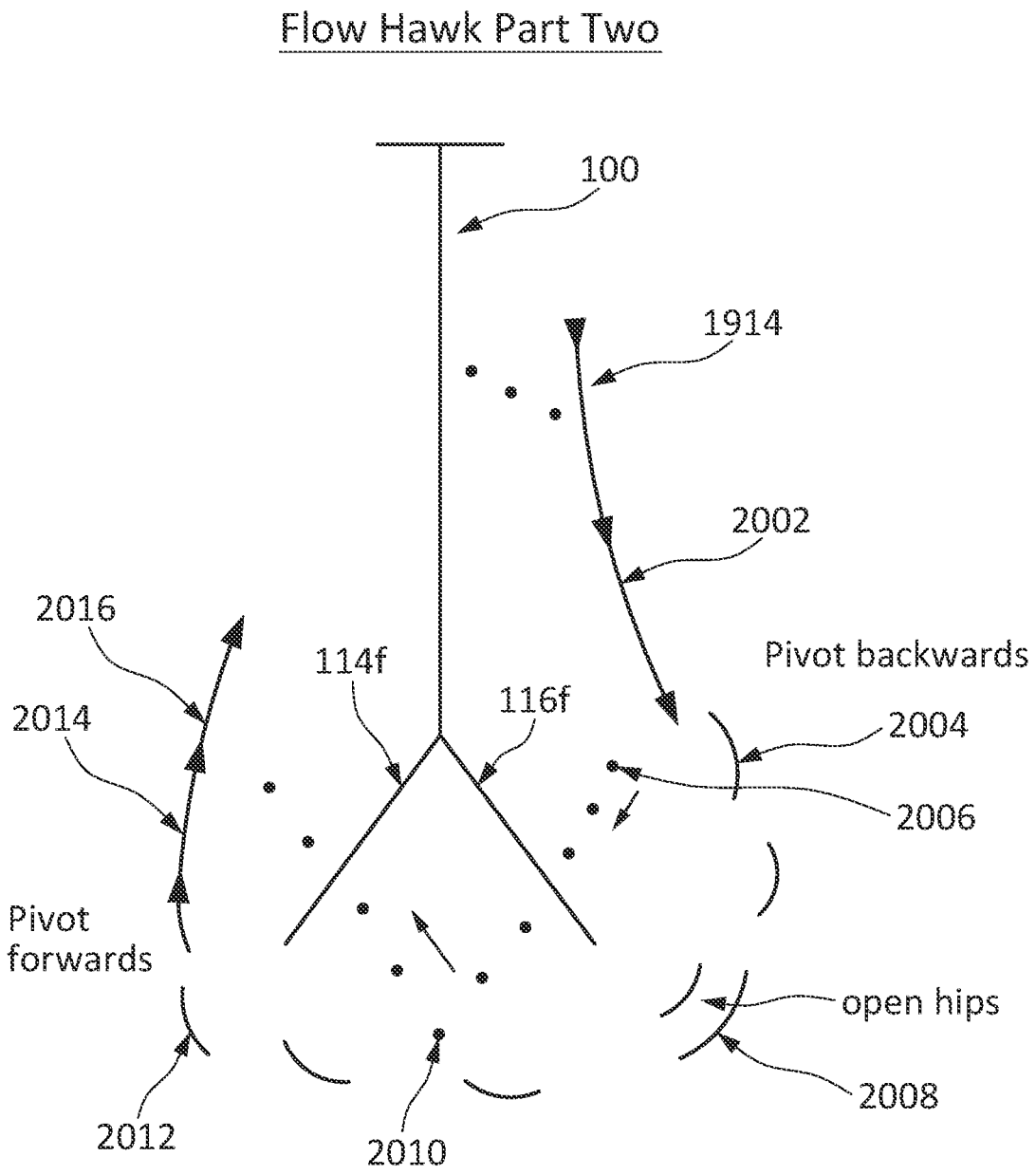
Figure 21:
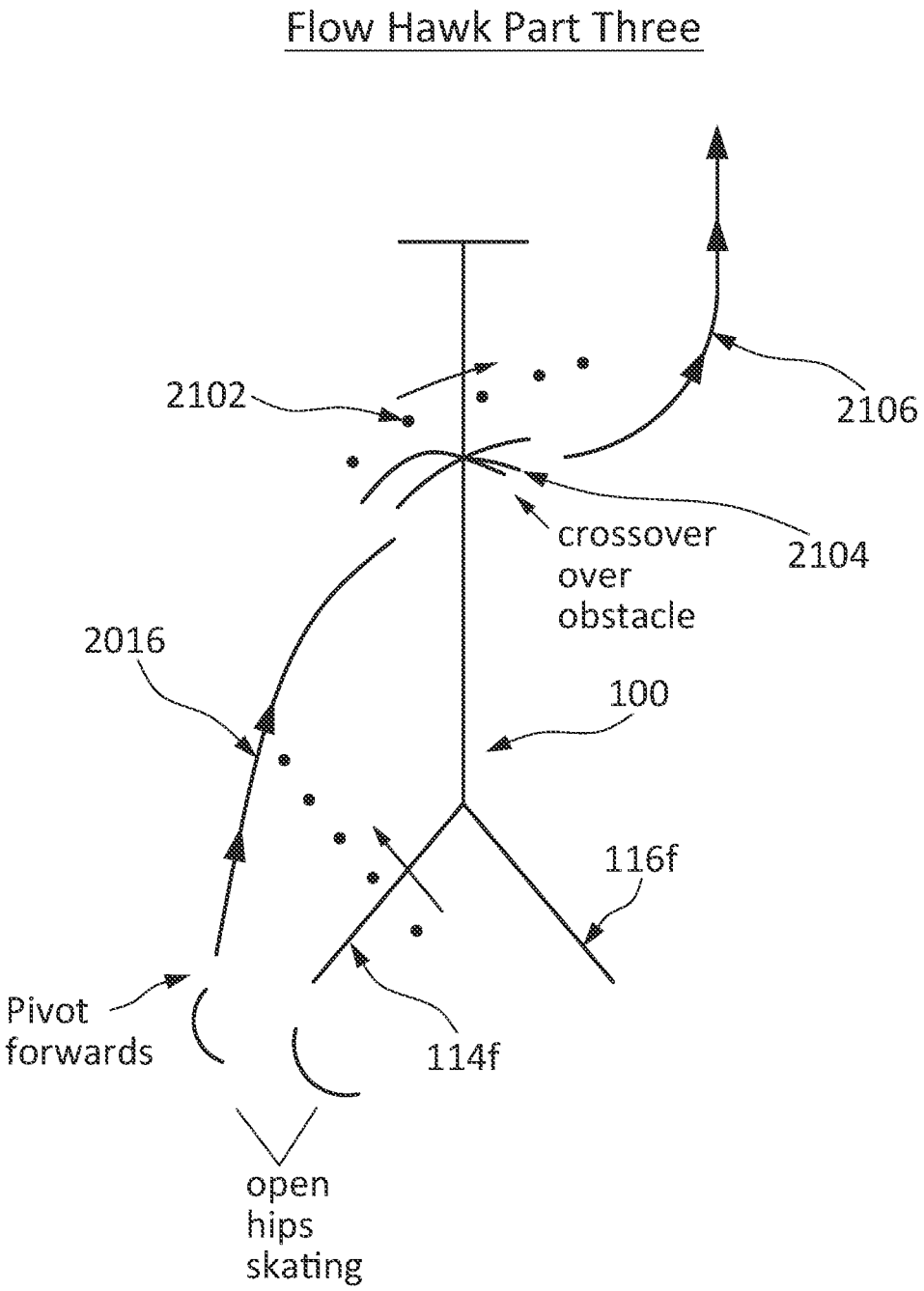

Turning to FIGS. 19 to 21, a diagram of example drill patterns around the training device 100 are presented. In FIG. 19, a player path is presented and generally travels around the training device 100. The path begins with a player approach 1902 to the pair of forward swept stick members 114*f*, 116*f*. When the player reaches the stick members 114*f*, 116*f*, the player performed a hip open 1904 and passes a puck under the stick member 114*f*. The player continues and receives the puck at 1908. When the player reaches the opening under the telescoping portion of the training device 100, the player passes the puck under the telescoping portion at 1910. The player circles around the support 108 of the training device 100 at 1912 and receives the puck at 1914. As may be observed, as the training device 100 is telescoped, the portion where the puck may pass under increases but likewise so does the distance that the player traverses increasing difficulty.

In FIG. 20, the player may continue from step 1914 from FIG. 19 where the player has received the puck. The player proceeds along the training device 100 at step 2002 and may pivot backward 2004. During the pivot backward 2004, the player passes the puck under the stick member 116*f* at step 2006. The player then performs one or more hip opens from 2008 to 2012 as the player circles around the stick members 116*f*, 114*f*. The player deflects the puck at step 2010 under the other stick member 114*f*. The player then pivots forward at 2014 and receives the deflected puck at 2016.

In FIG. 21, the player may continue from step 2016 from FIG. 20 where the player has received the puck. The player proceeds towards the telescoping member 106 and passes the puck underneath the telescoping member 106 at 2102. The player then performs a crossover 2104 by either stepping over or jumping over the training device 100. The player receives the puck at 2106 and proceeds to skate away from the training device 100.

Figure 22:
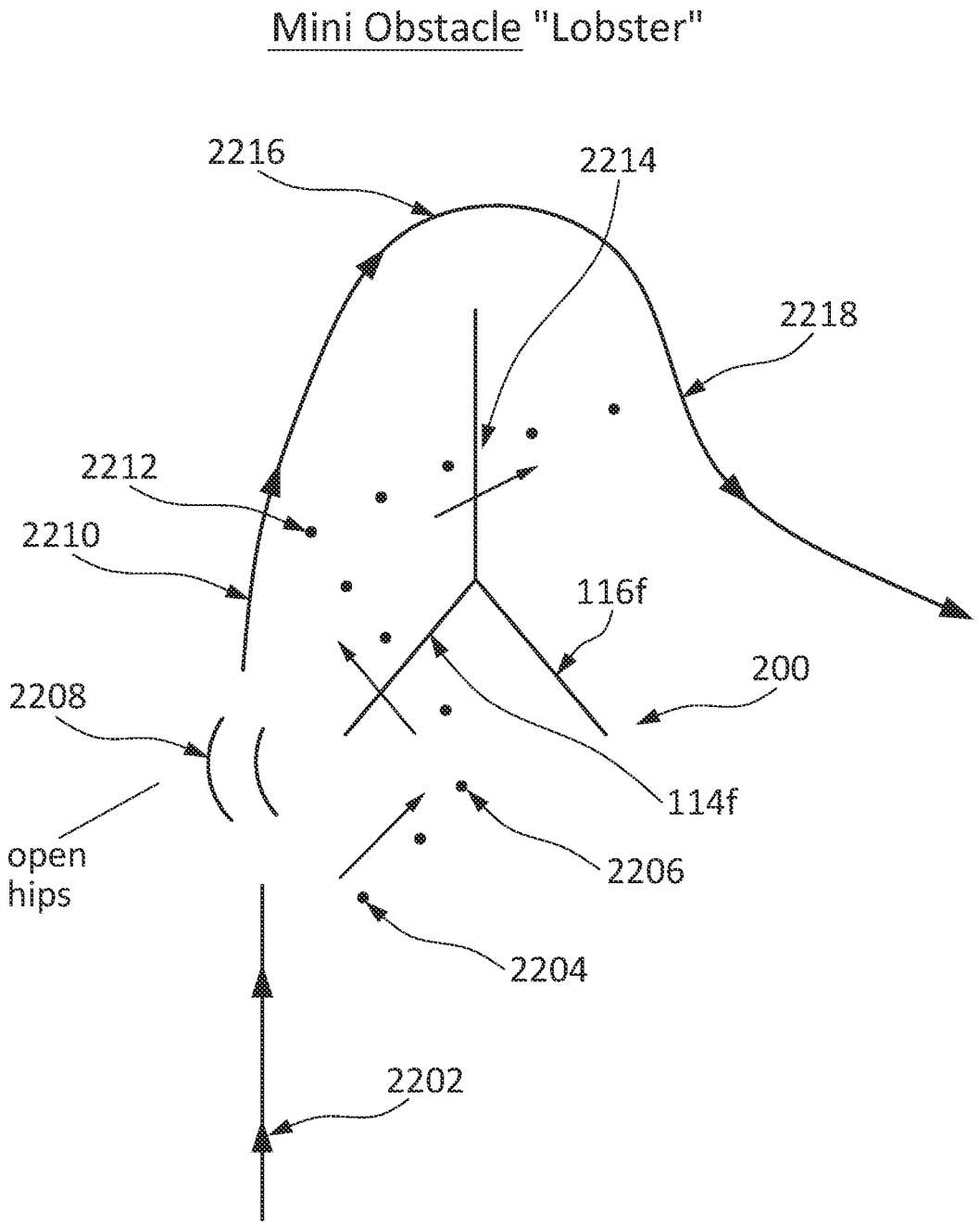
FIG. 22 is an overhead view sketch demonstrating a "lobster" configuration and an example drill pattern using the training device of FIG. 10.

Turning now to FIG. 22, the training device 200 where the stick members 114*f*, 116*f* may be configured in a "lobster" configuration as shown. The player approaches (at step 2202) stick members 114*f*, 116*f* end of the training device 200. The player maneuvers the puck in a zig-zag pattern at steps 2204 to step 2206 to step 2212 to pass the puck underneath the stick member 114*f* While the player is performing this zig-zag maneuver, the player pivots enters an open hips position at 2208. Once the puck has passed under the stick member 114*f*, the player continues to skate forward 2210 and receives the puck at step 2212. The player then deflects the puck underneath the training device 200 at step 2214. The player then circles around the end of the training device 200 at step 2216 to receive the puck at step 2218.

Figure 23:
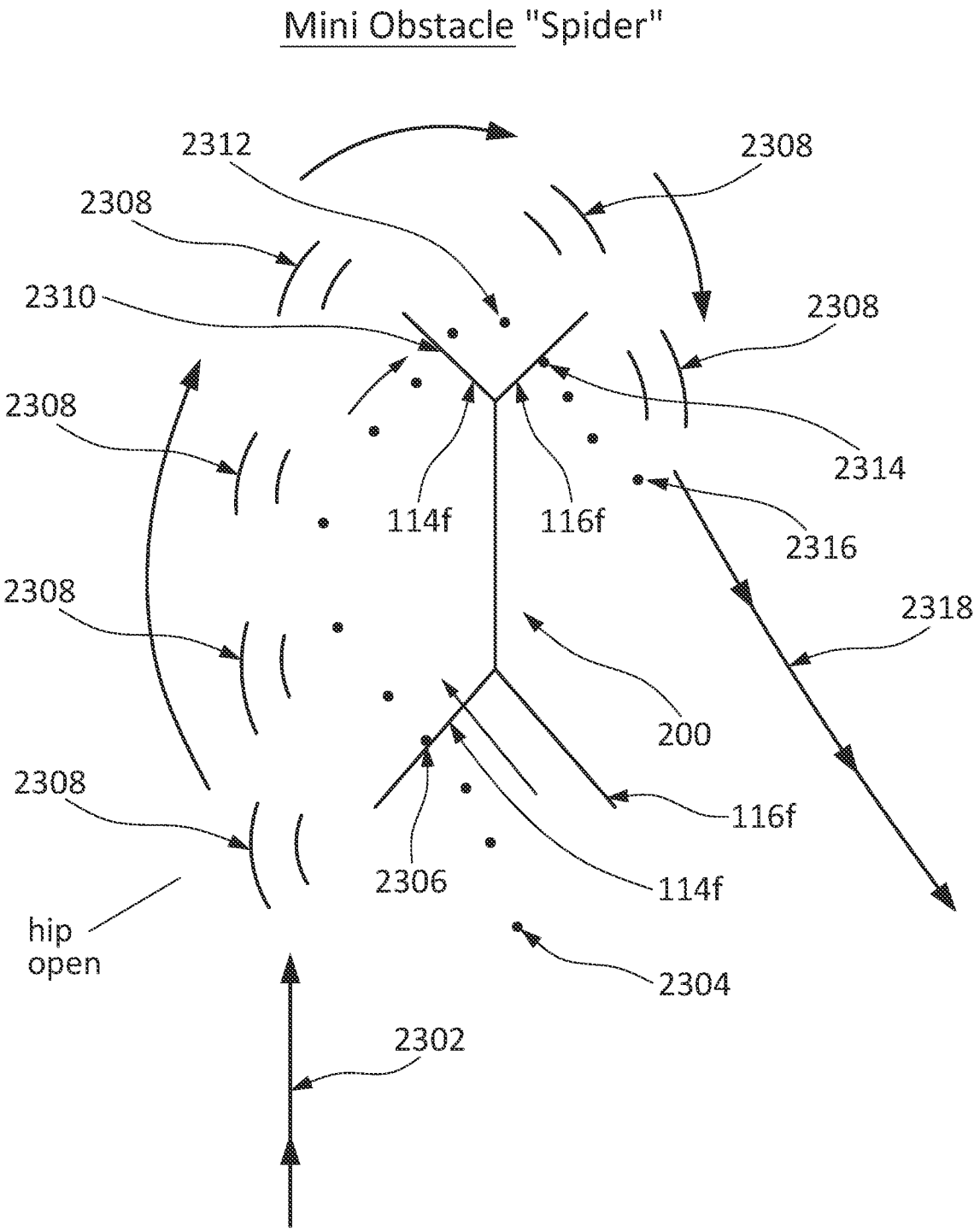
FIG. 23 is an overhead view sketch demonstrating a "spider" configuration and an example drill pattern using the training device of FIG. 10.

As shown in FIG. 23, the training device 200 may have the stick members 114*f*, 116*f* on both ends of the training device 200. This configuration may be commonly called a "spider" configuration. Similarly, the player approaches the training device 200 at step 2302. The player then performs a plurality of hip opens at step 2308. During the first few hip opens 2308, the player weaves the puck through the stick member 114*f* at steps 2304 and 2306. Once the puck has passed under the stick member 114*f*, the player continues to perform hip opens 2308 until the player weaves the puck through the stick members 114*f*, 116*f* at the opposite end at steps 2310, 2312, and 2314. The player performs hip opens 2308 around the opposite end and receives the puck at step 2316. The player then skates off at step 2318 completing the maneuver.

Figure 24:
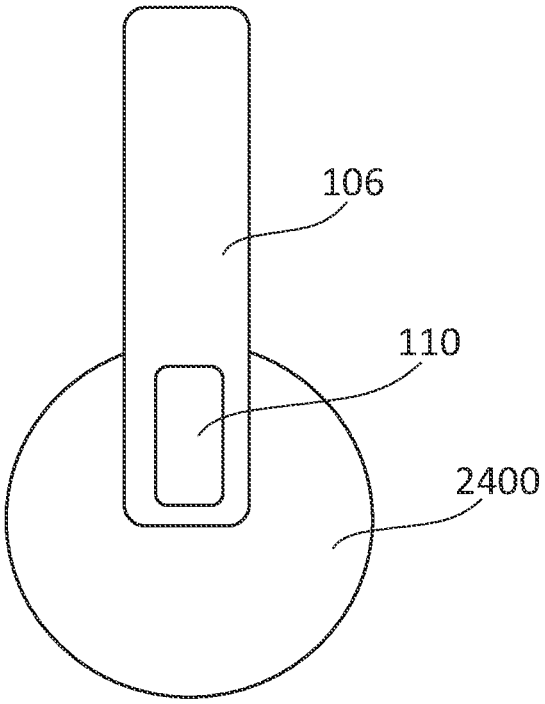
FIG. 24 is a top plan view of an end of the training device of FIG. 1 and/or FIG. 10.

In another aspect shown in FIG. 24, instead of the support 108 resembling a rectangular prism, the support 108 may be replaced with a puck or plate-shaped support 2400. The support 2400 may deflect the projectile away from the end of the telescoping member 106. The puck or plate-shaped support 2400 may additionally reduce the length of the support 108 while providing a similar surface area in contact with the playing surface. The reduced length of the plate-shaped support 2400 may prevent the support 2400 from interfering with the player and/or projectile.

A similar or even larger surface area may also provide similar contact characteristics prohibiting the end of the telescoping member 106 from moving on the playing surface. For example, the support 108 may have a length of 6-inches and width of 3-inches has a maximum contact area of 18 sq. inches (assuming that the entire bottom surface of the support 108 is in contact with the playing surface). The support 108 extends outward 3-inches on either side of the telescoping member 106. Whereas for the plate-shaped support 2400 having a radius of 2.5-inches, the plate-shaped support 2400 extends outward 2.5-inches on either side of the telescoping member 106. But the area of the plate-shaped support 2400 is approximately 19.6 sq. inches (assuming that the entire bottom surface of the support 2400 is in contact with the playing surface). Although this aspect presents a complete cylinder for the plate-shaped support 2400, other aspects may be semi-circular with the circular edge opposite the end of the telescoping member 106.

Figure 25:
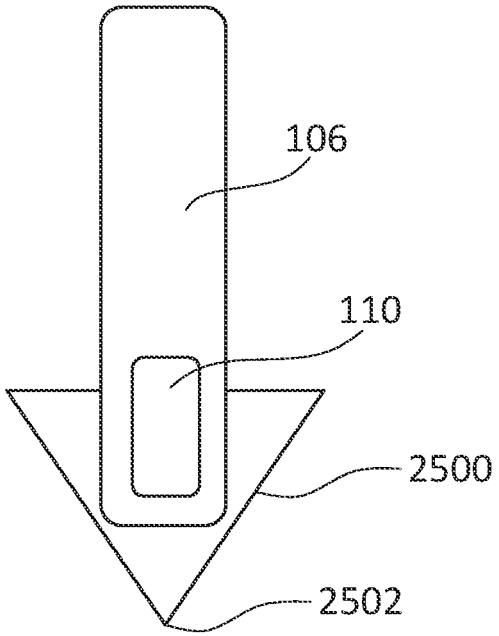
FIG. 25 is a top plan view of an end of the training device of FIG. 1 and/or FIG. 10.

Turning to FIG. 25, instead of the support 108 resembling a rectangular prism or a plate-shaped support 2400, the support 108, 2400 may be replaced with a triangular-shaped support 2500. The support 2500 may deflect the projectile away from the end of the telescoping member 106 similar to the plate-shaped support 2400 but may provide a more controllable deflection surface than the plate-shaped support 2400. The triangular support 2500 may additionally reduce bounce back (e.g. where the projectile strikes the support 108, 2400 and results in the projectile moving in an opposite direction to the motion of the player) when the player approaches from an apex end 2502 of the triangular support 2500. The only place where such a bounce back may occur is when the projectile strikes the apex of the triangle 2502, which has a relatively narrow angle.

Although the aspects herein demonstrate a pair of sticks 114, 116 being received in each of the slots 110, 112, 210, 212, other aspects may comprise more than two sticks 114, 116 being received in each of the slots 110, 112, 210, 212. Other aspects may comprise only a single stick 114, 116 being received in each of the slots 110, 112, 210, 212. Although the aspects herein demonstrate sticks 114, 116 only at one end, other aspects may comprise sticks 114, 116 in all of the slots 110, 112, 210, 212.

Although the aspects herein demonstrate the support 108, 2400, 2500 at the end of the telescoping member 106, other aspects may also have the support 108, 2400, 2500 at the end of the elongate base support 102. Although the supports 108, 2400, 2500 may be described herein on the training device 100 of FIG. 1, other aspects may have these supports 108, 2400, 2500 on the training device 200 of FIG. 10.

Figure 27:
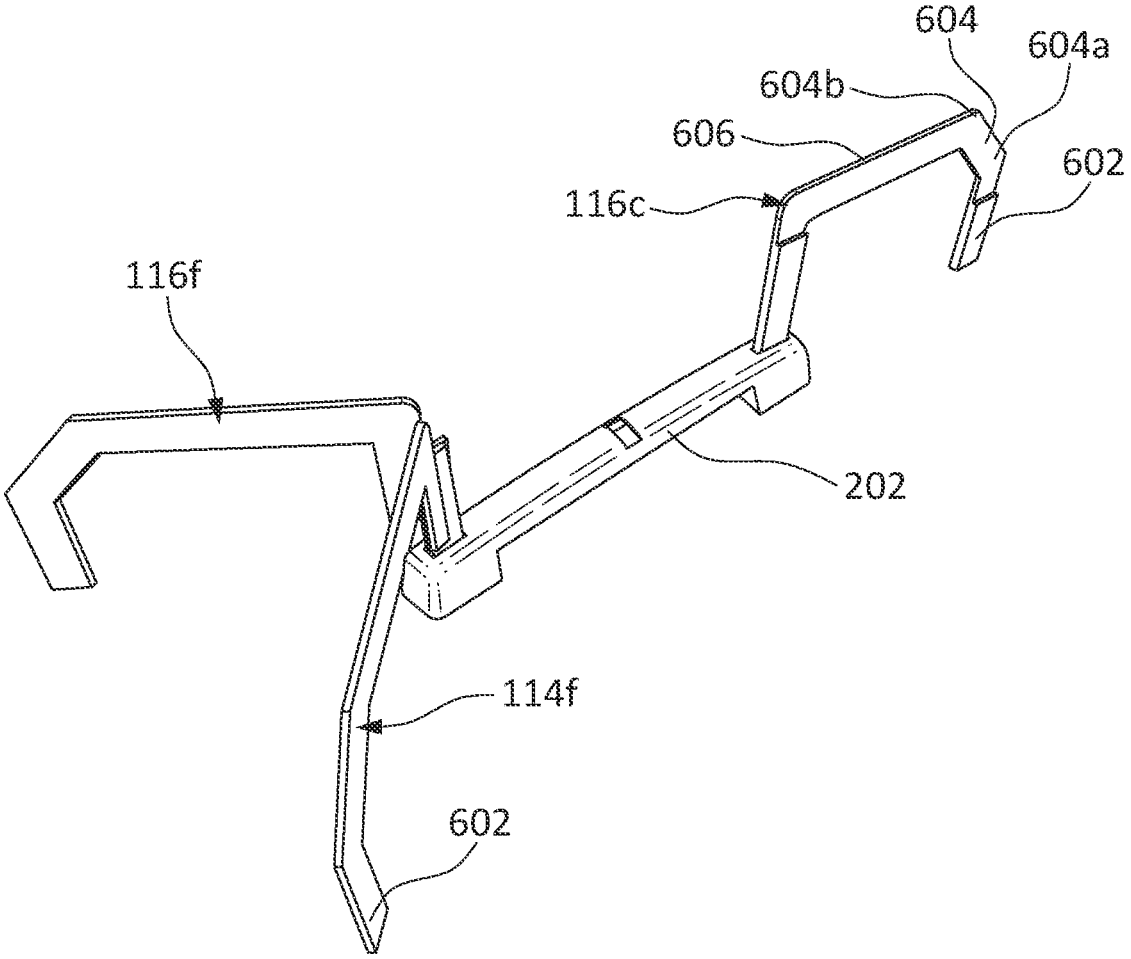
FIG. 27 is a photograph of a perspective view of the training device of FIG. 10 demonstrating another configuration of the stick member.

In another aspect, the stick member 116 may comprise a vertical toe 602 configured to rest on the playing surface. For example the stick member 114*f*, 116*f*, and 116*c* as shown in FIG. 27 each has the vertical toe 602. The toe 602 may be coupled to a vertical portion 604*a* of the bow 604. A main body 604*b* of the bow 604 extends upward from the vertical portion 604*a* at approximately 45-degrees. An upper end of the main body 604*b* may be coupled to a generally horizontal leg 606. In an aspect, the vertical toe 602 may be directly coupled to the main body of the bow 604. In another aspect, the bow 604 and the horizontal leg 606 may be manufactured from one piece of material. The vertical configuration of the toe 602 may enable the stick member 116*c* to couple more easily into a slot of another base member.

Figure 28:
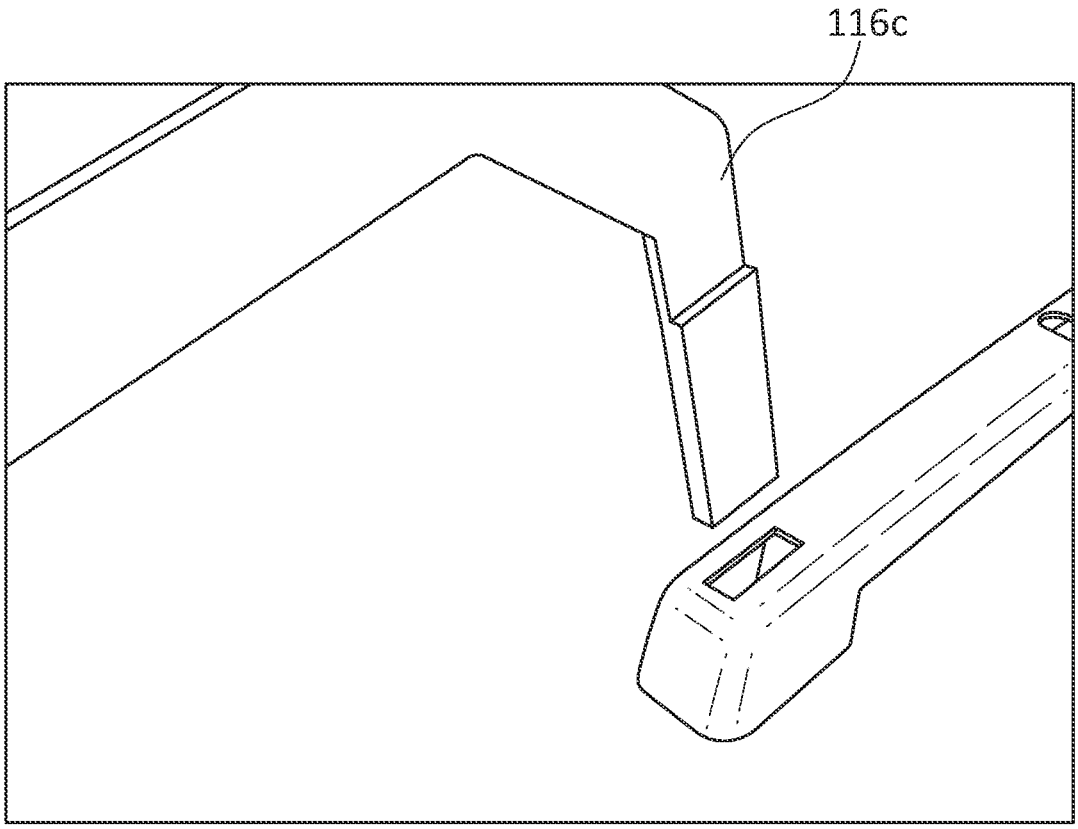
FIG. 28 is a close up photograph of the stick member of the training device of FIG. 27 used in conjunction with the training device of FIG. 10.
Figure 29:
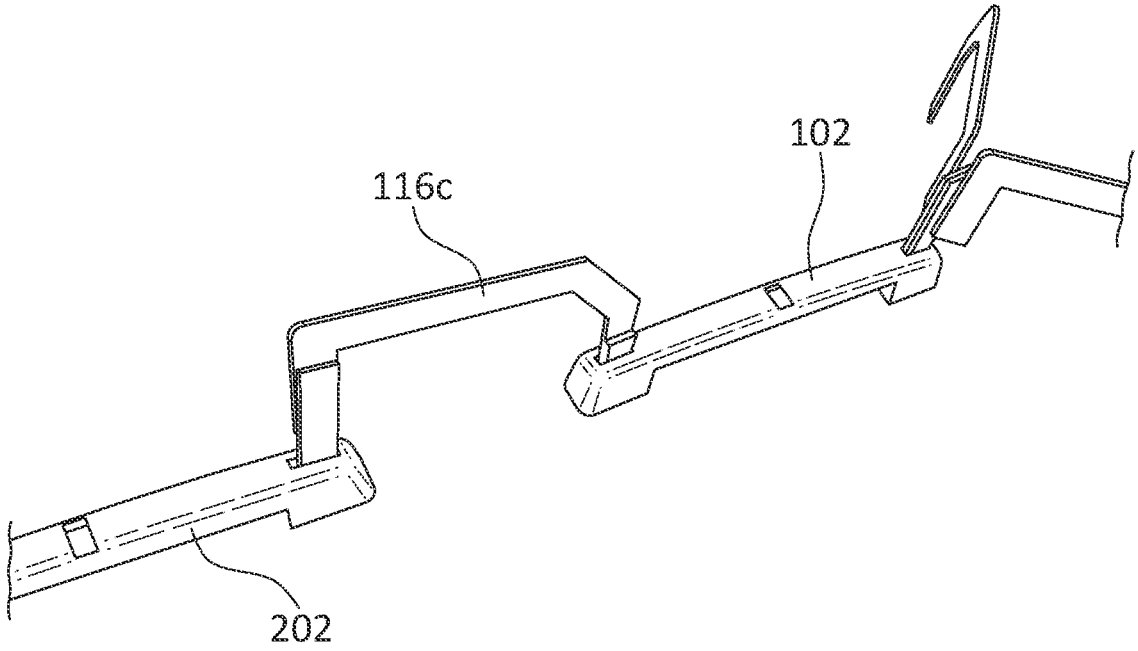
FIG. 29 is a photograph of a perspective view the training device of FIG. 27 used in conjunction with the training device of FIG. 10.
Figure 30:
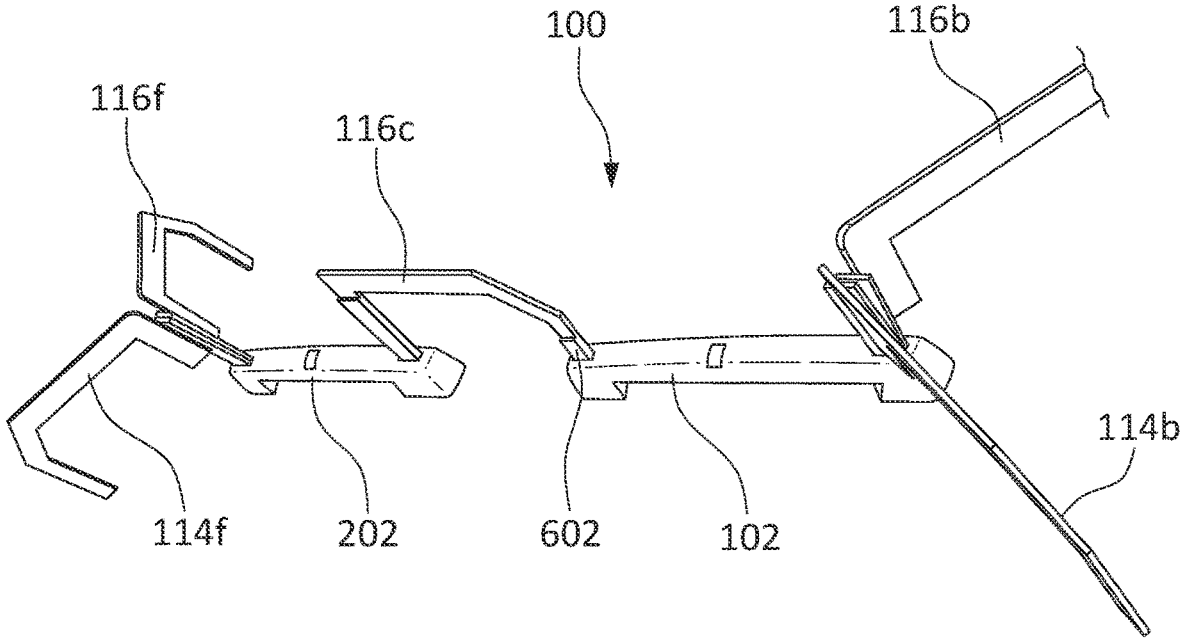
FIG. 30 is a photograph of another perspective view of the training device of FIG. 27 used in conjunction with the training device of FIG. 10.

In an aspect, the training device 100 may be extended via the central stick member 116*c* as shown in FIGS. 28 to 30, The toe 602 of the central stick 116*c* of the training device shown in FIG. 27 may be placed in a slot of another base support 102. The other end of the base support 102 may also be coupled with another pair of stick members 114*b* and 116*b*. Unlike the configuration of FIG. 17, in this aspect, the two pairs of sticks 114*b*, 116*b* and 114*f*, 116*f* are both forward swept.

Figure 31:
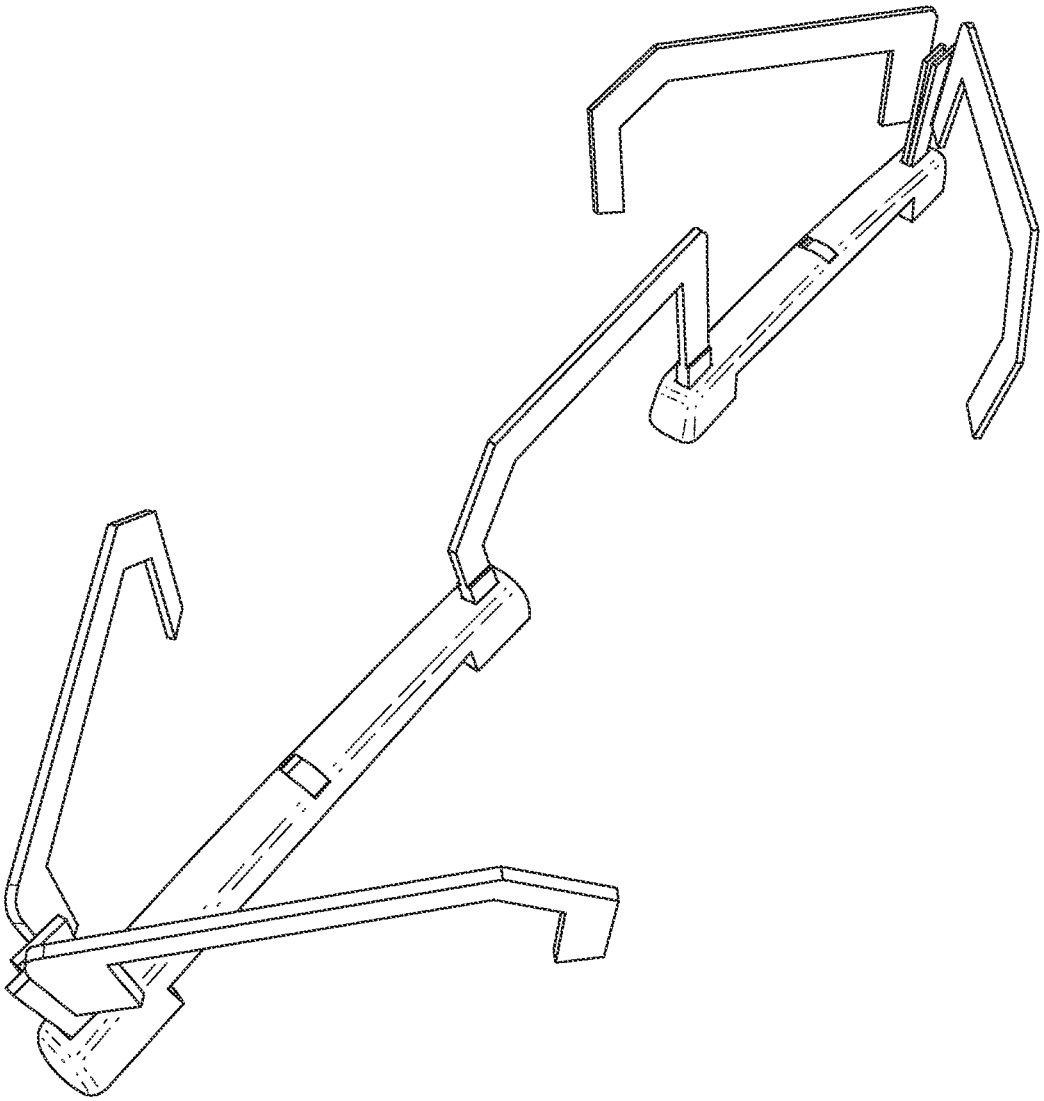
FIG. 31 is a photograph of another configuration of the training device of FIG. 30.
Figure 32:
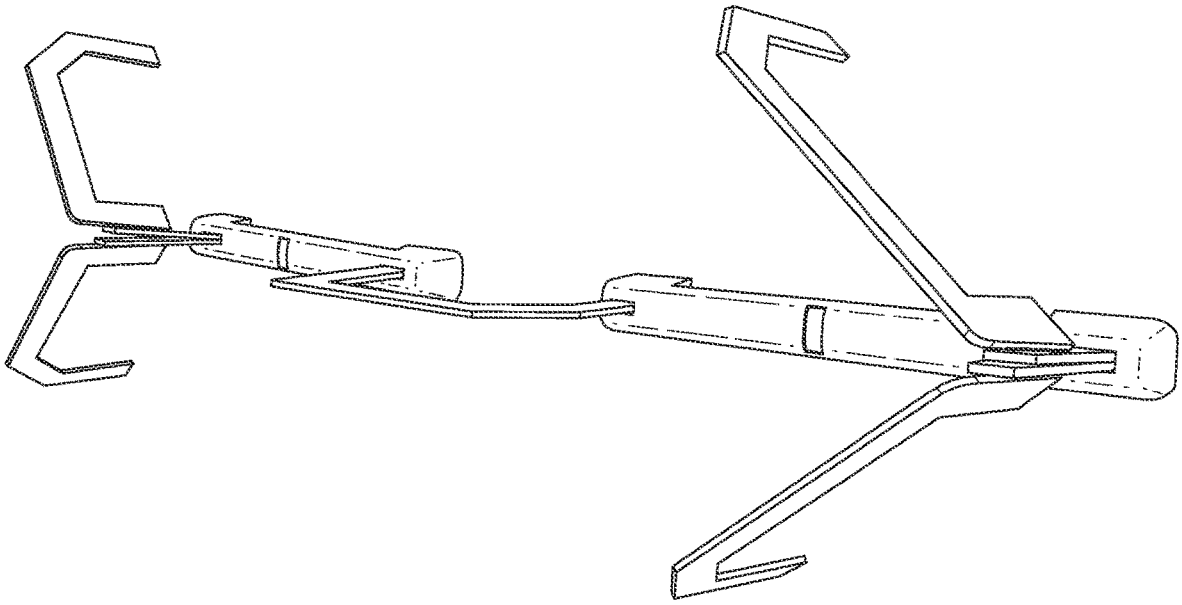
FIG. 32 is a photograph of another configuration of the training device of FIG. 30.
Figure 33:
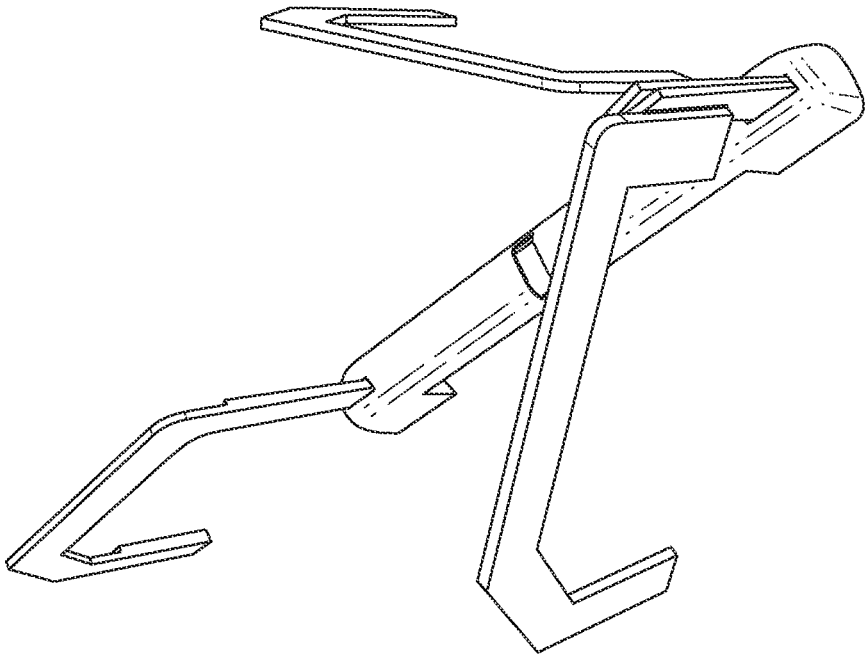
FIG. 33 is a photograph of another configuration of the training device of FIG. 27.
Figure 34:
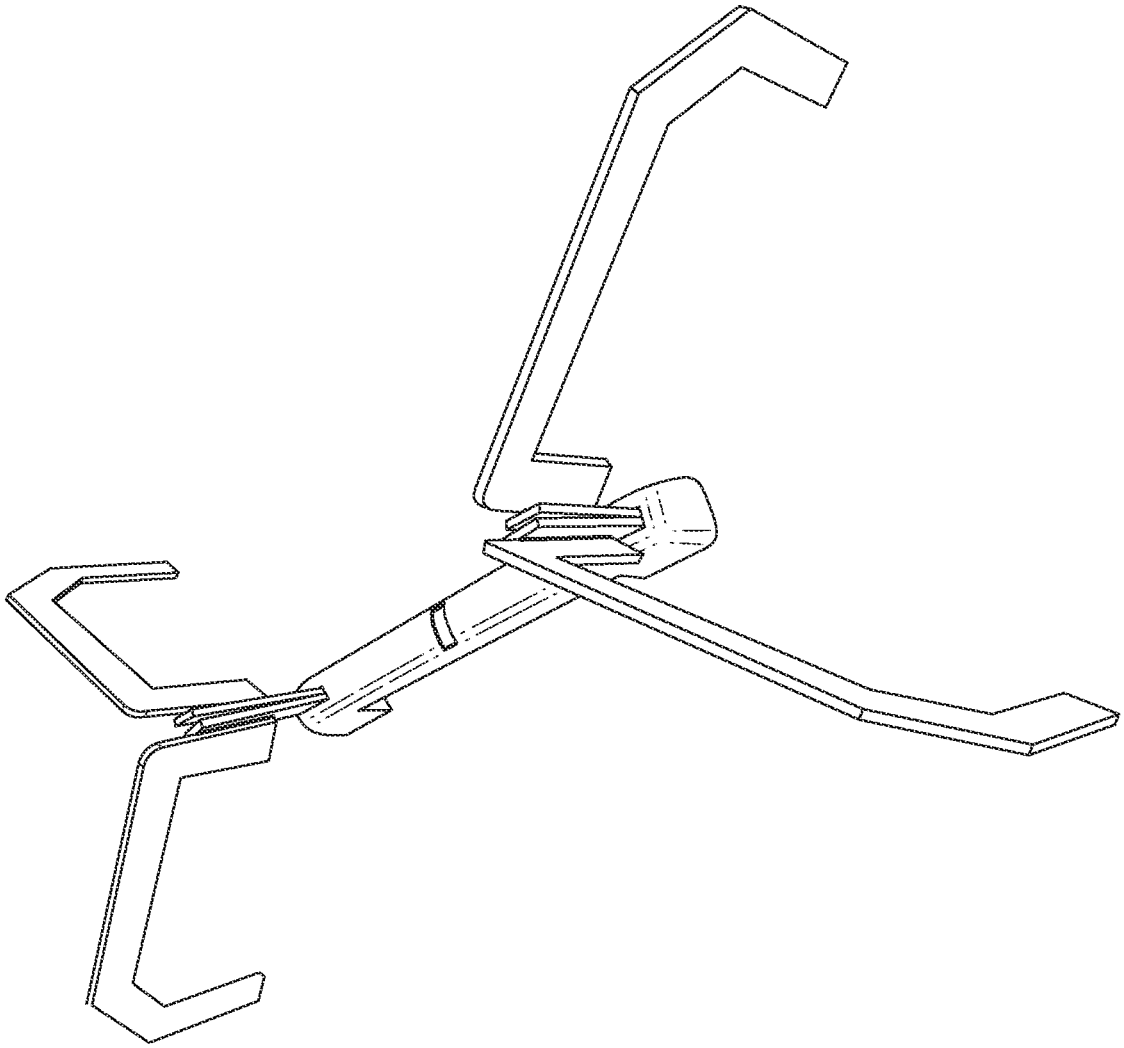
FIG. 34 is a photograph of another configuration of the training device of FIG. 27.

In another aspect, the two pairs of stick 114*b*, 116*b* and 114*f*, 116*f* of the training device 100 shown in FIG. 30 could be configured to both backward swept as shown in FIG. 31. In another configuration, one pair of stick is forward swept and the other pair is forward swept as shown in and FIG. 32. Similarly, the training device 100 shown in FIG. 27 could be configured such that one pair of sticks at one end may be backward swept and the other end may only have one single stick as shown in FIG. 33. FIG. 34 shows yet another example of the training device 100 having a pairs of sticks at each of the two ends of the base support and the two pairs of sticks are both configured to have forward swept.

Figure 35:
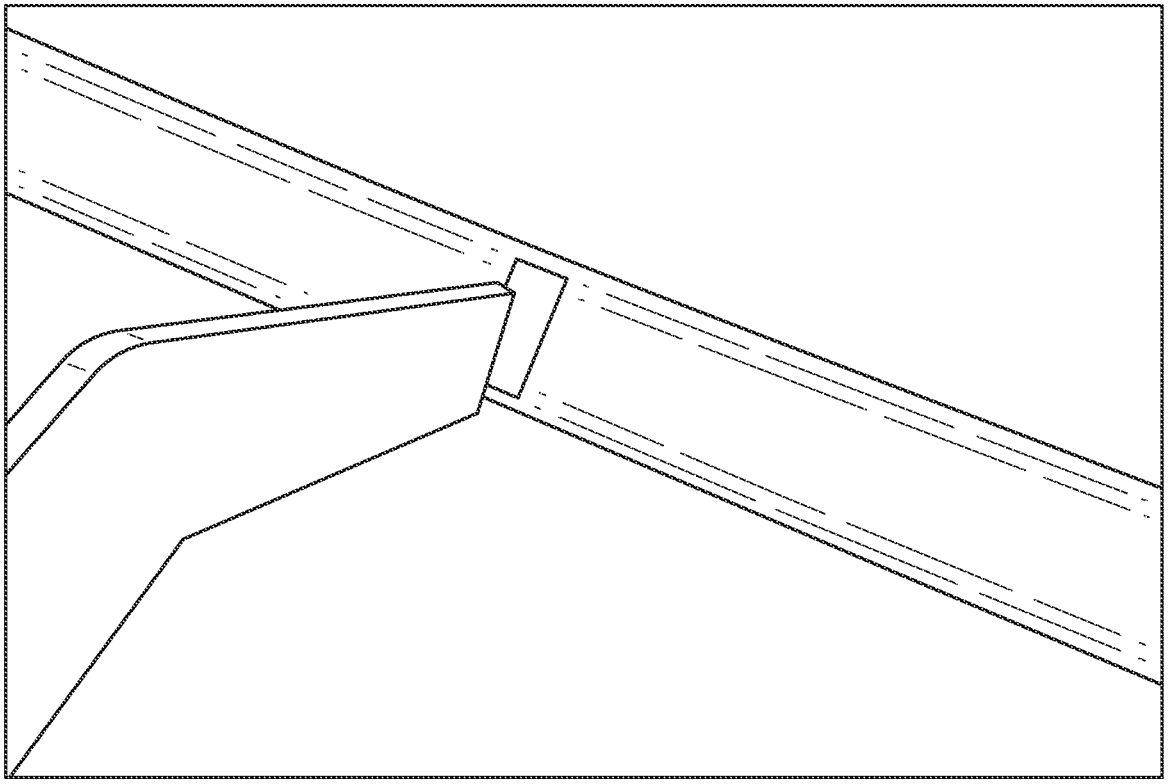
FIG. 35 is a close up photograph of a stick member ready to couple to a central slot of a base support.
Figure 36:
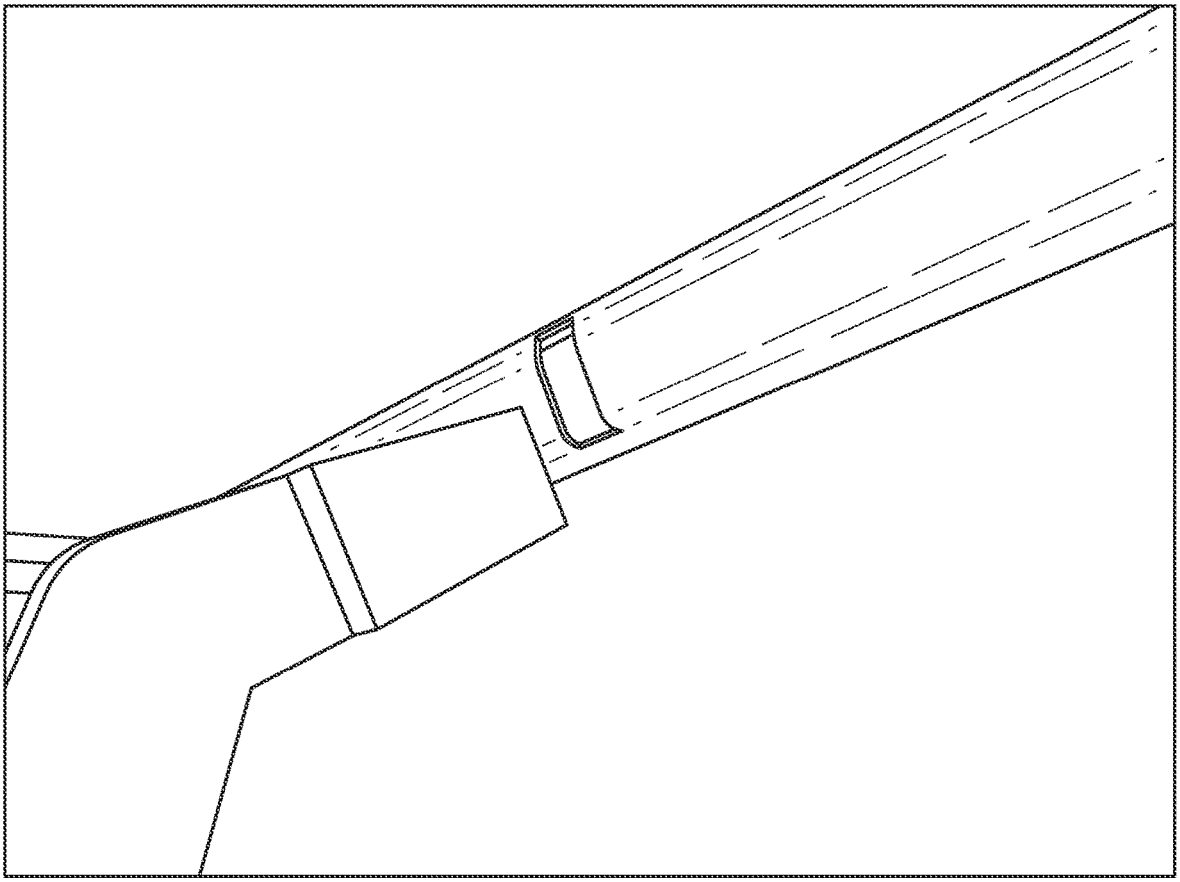
FIG. 36 is a close up photograph of a stick member ready to couple to a central slot of a base support.
Figure 37:
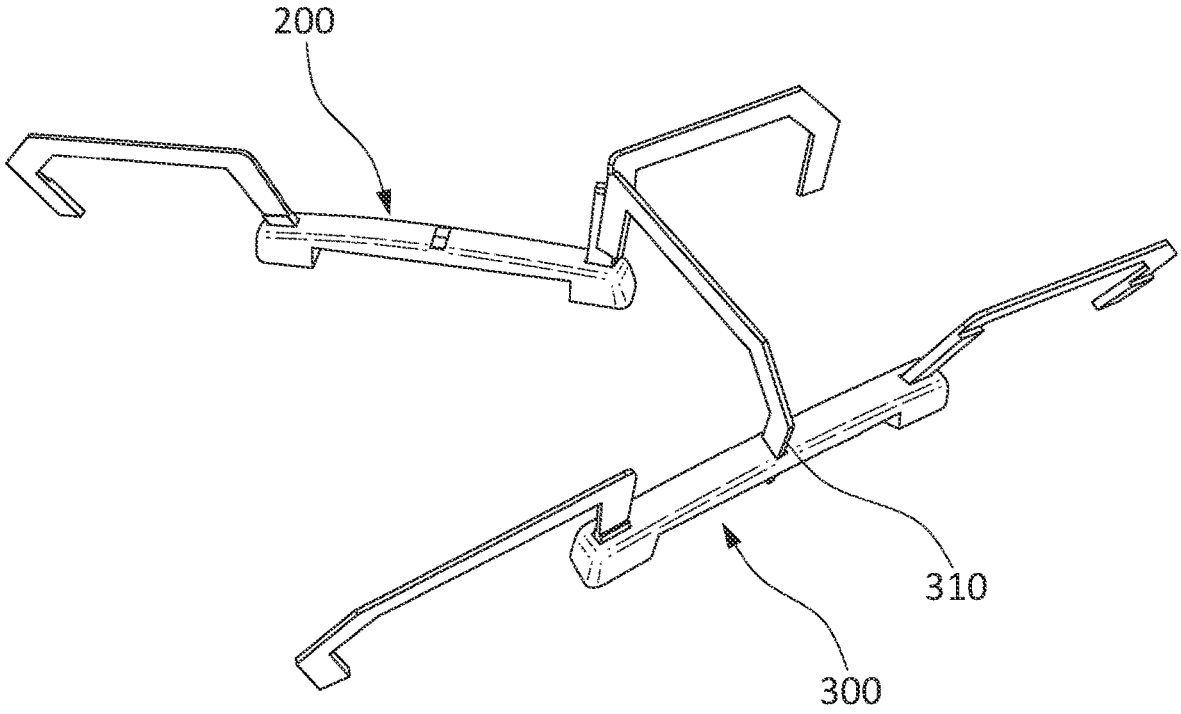
FIG. 37 is a photograph of one configuration of the training device of FIG. 27 used in conjunction with a second training device.
Figure 38:
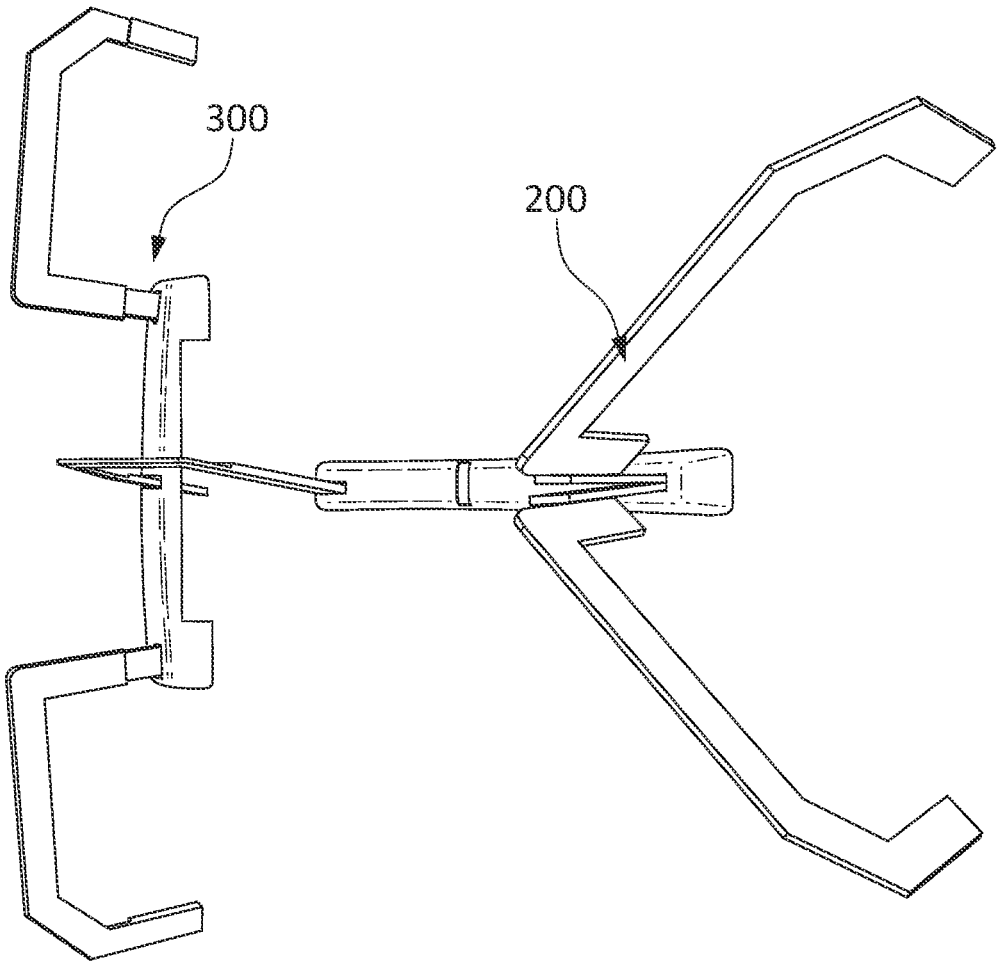
FIG. 38 is a photograph of another configuration of the training device of FIG. 27 used in conjunction with a second training device.
Figure 39:
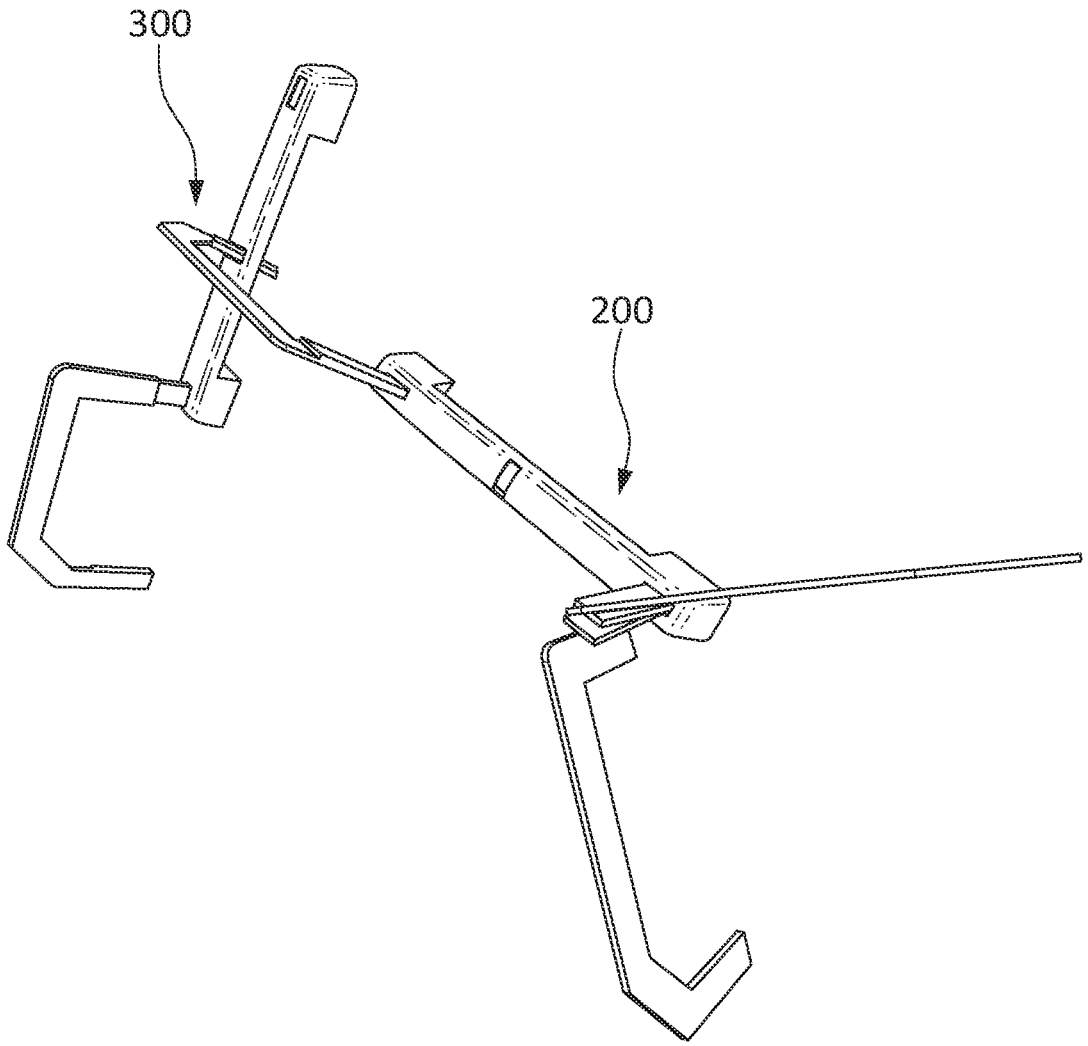
FIG. 39 is a photograph of another configuration of the training device of FIG. 27 used in conjunction with a second training device.

In some aspects, the slot may be located at approximately the central part of the base support and may be perpendicular to (or generally across) the longitudinal direction of the base support as shown in FIG. 35 and FIG. 36. A stick toe of another training device can be inserted into the slot such that two training devices can be easily coupled together. FIGS. 37 to 44 shows examples that a first training device 200 is coupled to a second training device 300 via the central slot 310. In the examples of FIGS. 37 to 44, the base support of the second training device 300 has a central slot 310 perpendicular to the base support, The toe of one stick of the first training device may be inserted into the central slot 310 of the second training device 300. The base support of the second training device may be perpendicular to the base support of the first training device.

Figure 40:
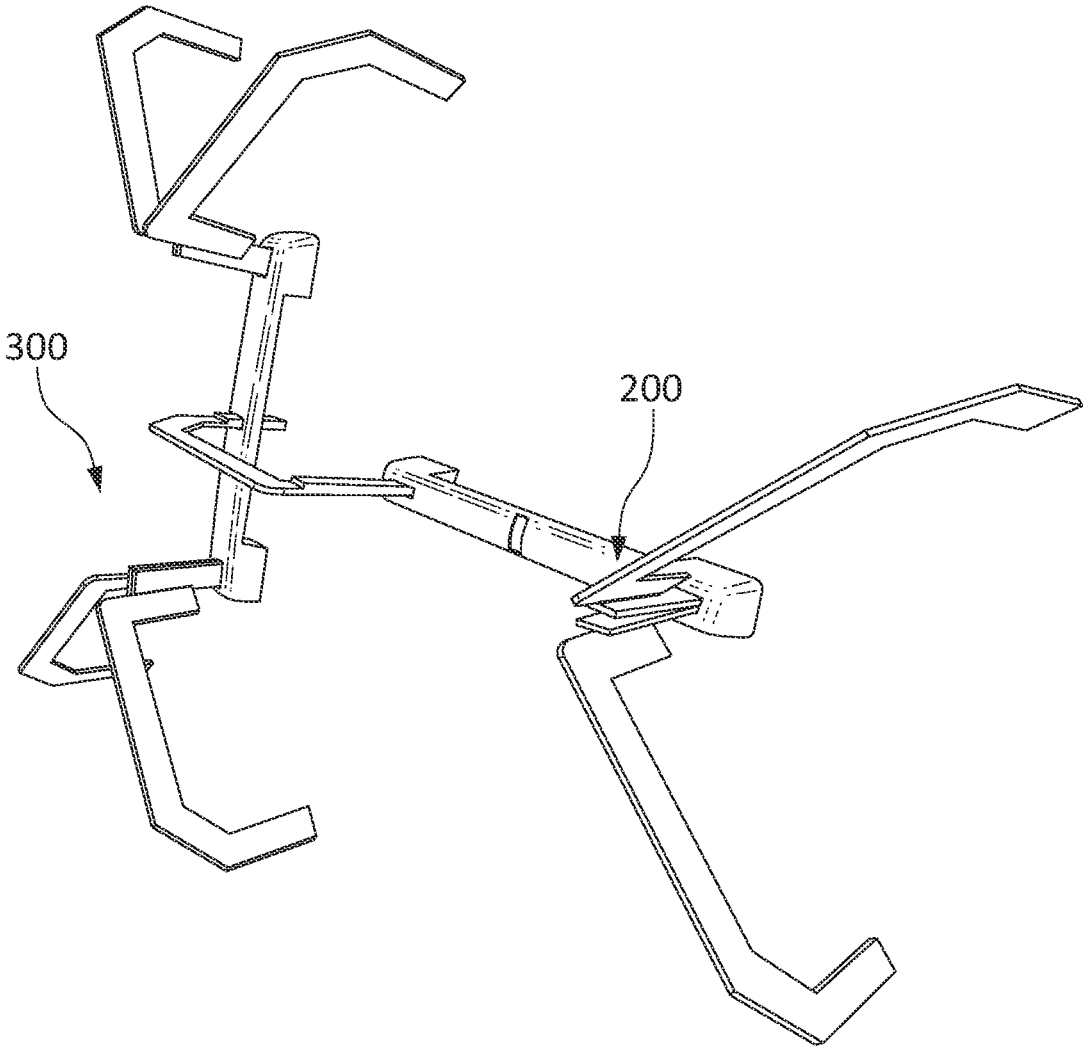
FIG. 40 is a photograph of another configuration of the training device of FIG. 27 used in conjunction with a second training device.
Figure 41:
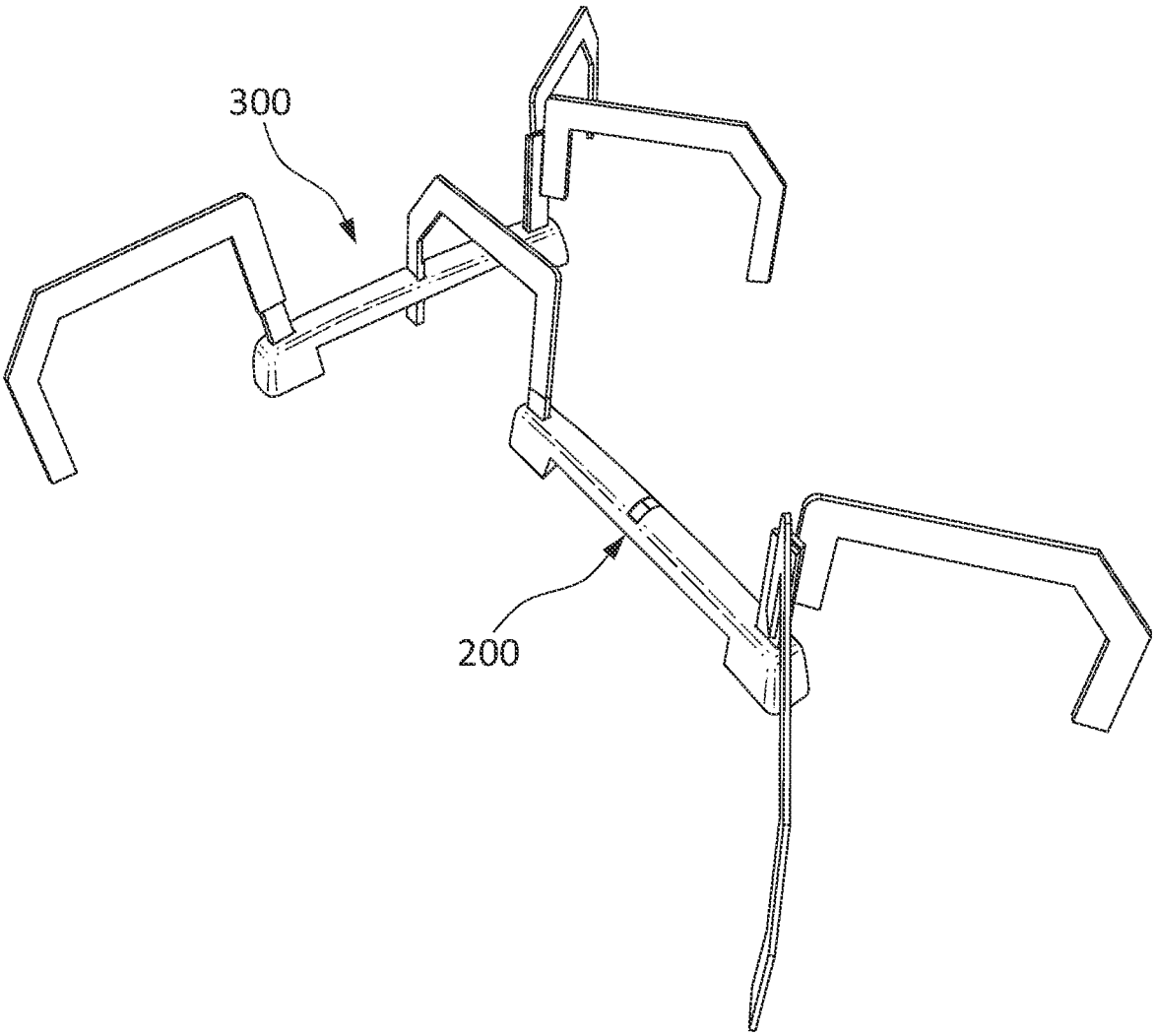
FIG. 41 is a photograph of another configuration of the training device of FIG. 27 used in conjunction with a second training device.

In some aspects, the second training device 300 can have different configurations. For example, the second training device 300 in FIG. 37 and FIG. 38 may have a single stick coupled to each of the two ends while the second device training device 300 in FIG. 39 only has one single stick coupled to one end. FIG. 40 shows an example that the second training device has a pair of sticks coupled to each of the two ends while the second training device in FIG. 41 has one pair of sticks coupled to one end and a single stick coupled to the other end.

Figure 42:
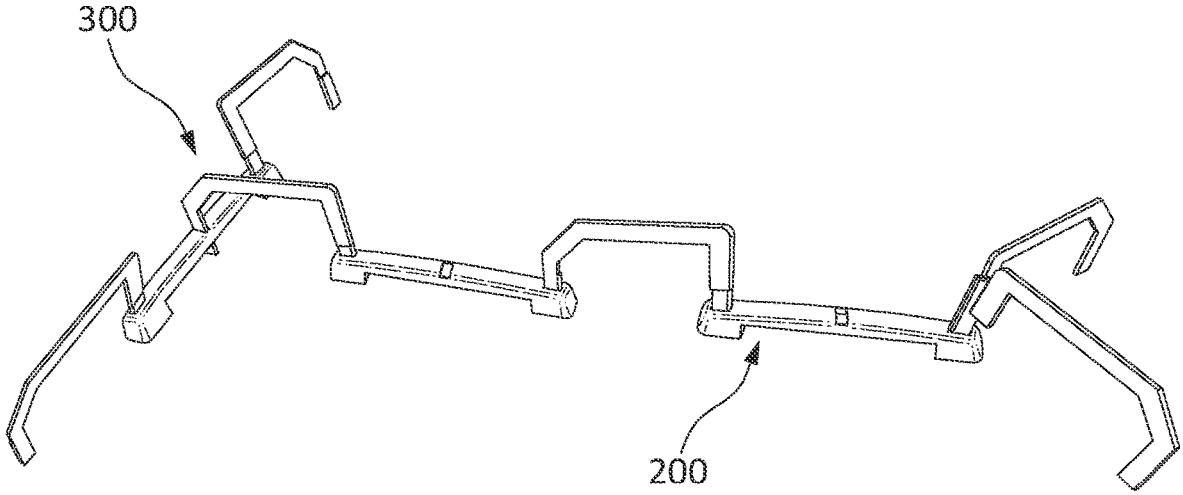
FIG. 42 is a photograph of another configuration of the training device of FIG. 29 used in conjunction with a second training device.
Figure 43:
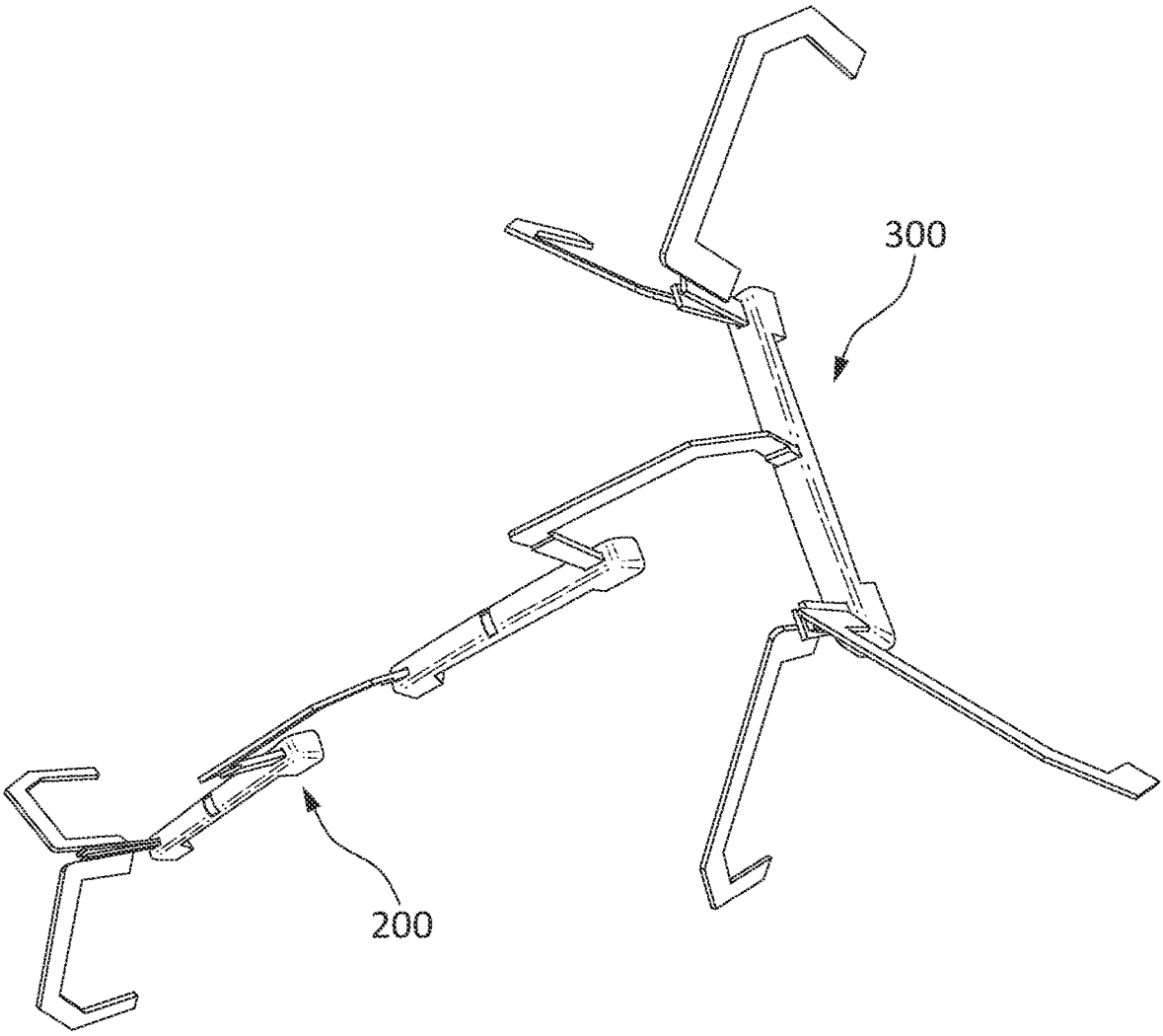
FIG. 43 is a photograph of another configuration of the training device of FIG. 29 used in conjunction with a second training device.
Figure 44:
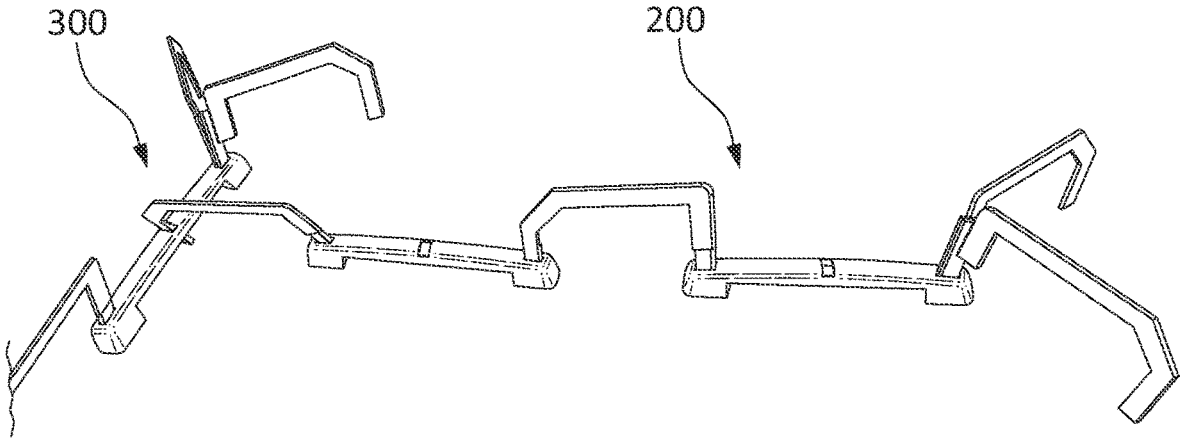
FIG. 44 is a photograph of another configuration of the training device of FIG. 29 used in conjunction with a second training device.

In some aspects, the first training device could be the configuration of FIG. 29 having an extended base support coupled by a central stick. FIGS. 42 to 44 shows the examples that the first training device 200 with an extended base support is coupled to the second training device 300. Similar to the examples of FIGS. 37 to 41, the second training device may have different configurations of the sticks.

Although the aspects herein describe that the central slot 310 located in the base support of the second training device 300. The central slot 310 may be configured to be located in the base support of the first training device 200.

Figure 45:
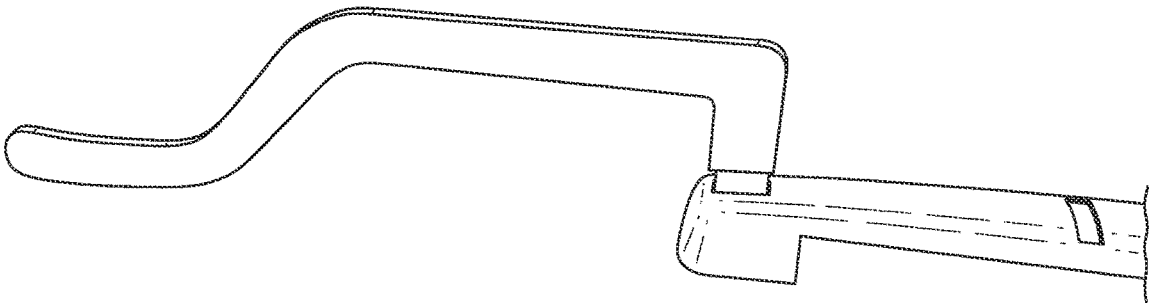
FIG. 45 is a photograph of a stick member coupled into a slot of a base support.
Figure 46:
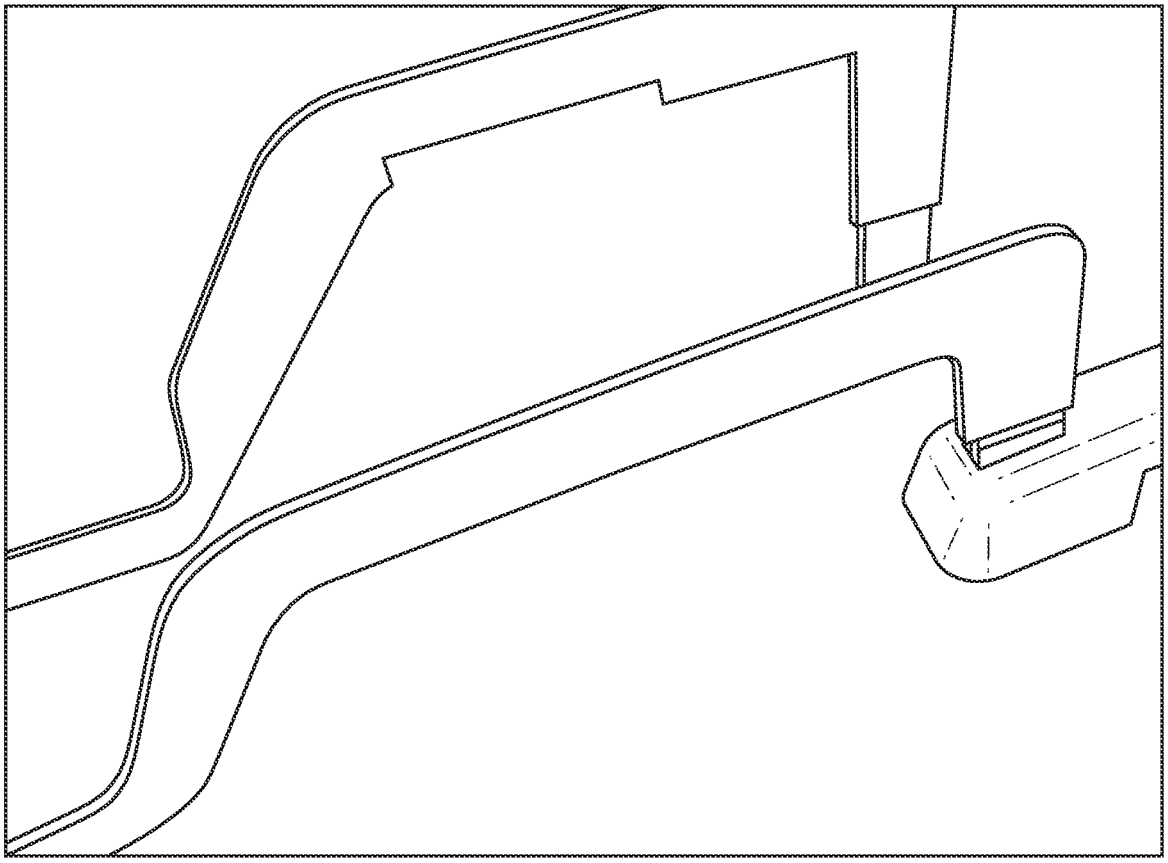
FIG. 46 is a photograph of the stick member of FIG. 45 compared with a traditional stick member.

In some aspects, the stick member may have a horizontal toe at one end and a vertical toe at the other end as shown in FIGS. 45 and 46. The stick member may have approximately a same width. The bow may extend smoothly upwards from the horizontal toe towards the horizontal leg. There may be a curved transition area between the horizontal toe and the bow, and a curved transition area between the bow and the horizontal leg.

Figure 47:
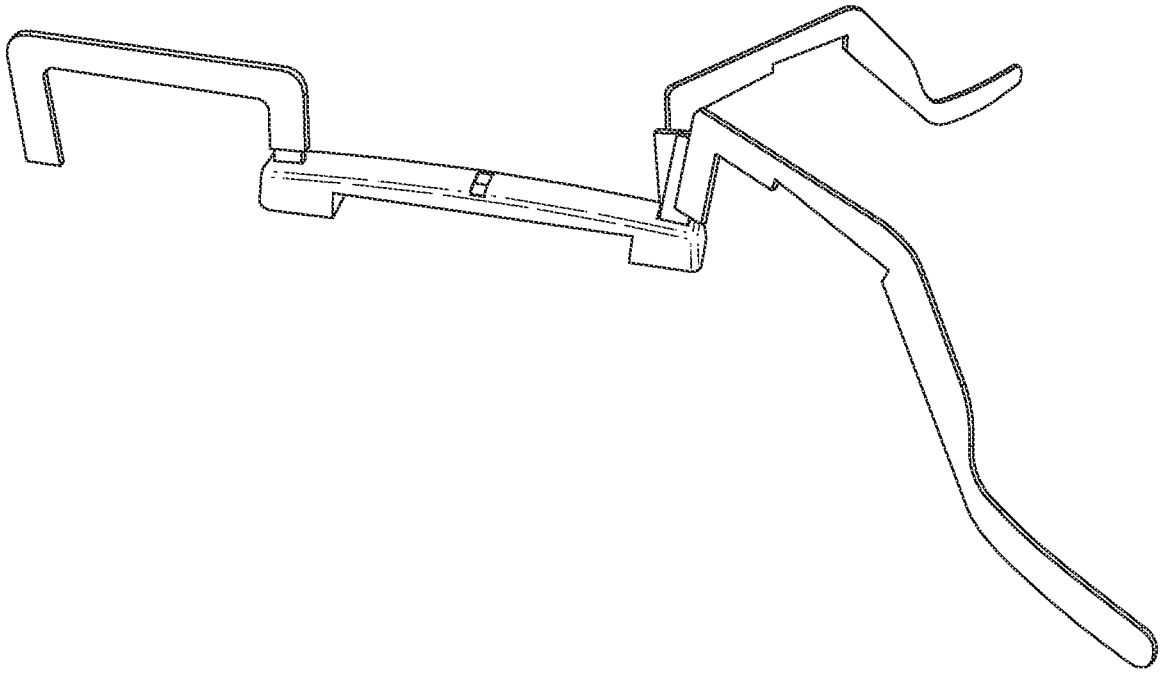
FIG. 47 is a photograph of another configuration of the training device of FIG. 27 having a pair of sticks with horizontal toes.

In some aspects, the training device may have a pair of sticks with horizontal toes at one end and a single stick with a vertical toe at the other end as shown in FIG. 47.

Figure 48:
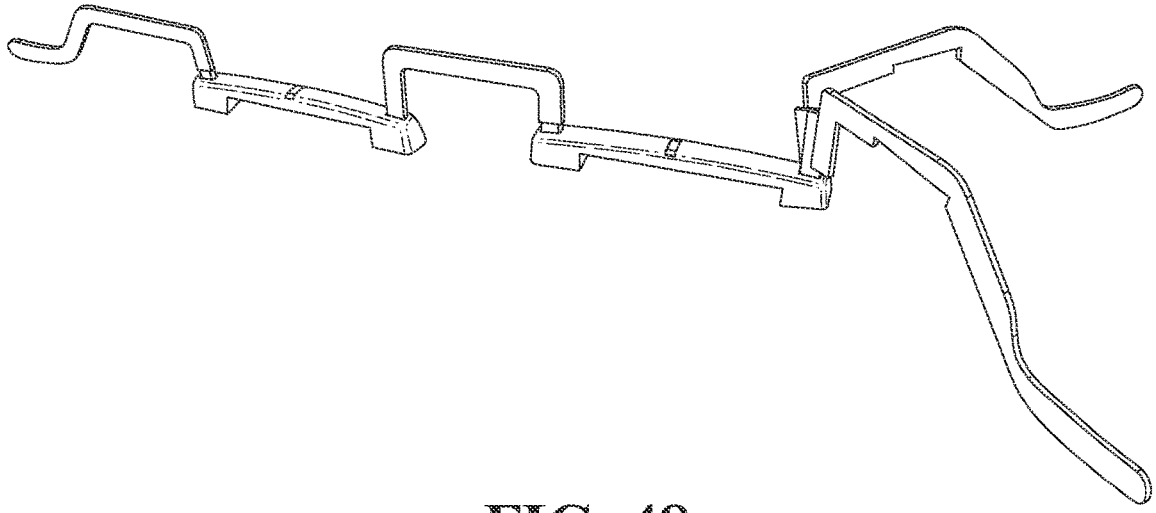
FIG. 48 is a photograph of a configuration of the training device of FIG. 47 used in conjunction with a second training device.
Figure 49:
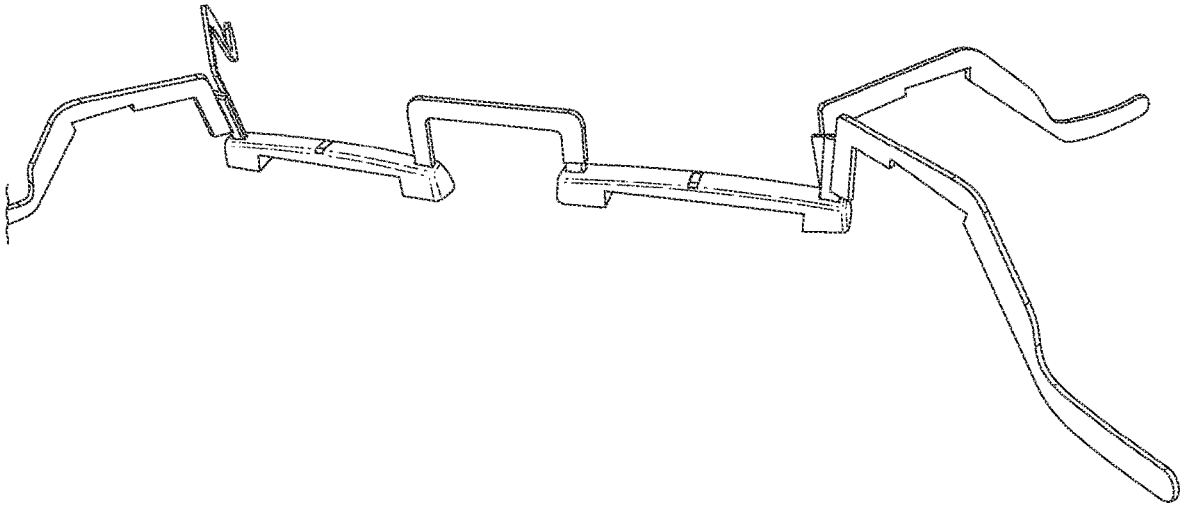
FIG. 49 is a photograph of another configuration of the training device of FIG. 47 used in conjunction with a second training device.

In yet another aspect, the vertical toe of the single stick of the training device shown in FIG. 47 may be inserted into a slot of a base support of a second training device. The second training device may have a single stick with a horizontal toe or a pair of sticks with horizontal toes as shown in FIG. 48 and FIG. 49.

In some aspects, the telescoping member 106 and the elongate base support 102 may comprise one or more fasteners in order to prohibit the telescoping member 106 from moving relative to the elongate base support 102. These fasteners may be to maintain the training device 100 in an in-use configuration and/or to maintain the training device in a storage configuration.

Although the aspects herein describe the support 108 as generally perpendicular to the telescoping member 106, other aspects may have the support 108 at an angle with respect to the telescoping member 106.

Although the aspects described herein refer to elements being coupled, other aspects may have the elements integrally formed. The components of the training devices 100, 200 and/or 300 may be constructed of fiberglass, plastic, rubber, and/or metal.

Although particular drill patterns have been described herein, these drill patterns are demonstrative and may be modified as is known to one of skill in the art.

Although the aspects herein demonstrate a particular height of the training devices 100 and/or 200. Other aspects may have training devices 100, 200, and/or 300 of different heights. For example, the height may be double what is presented herein in order to permit a soccer ball to pass therethrough.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A sport training apparatus comprising:

an elongated base member with a first end and a second end;

at least one stick member with a toe end and a shaft end; the at least one stick member removably coupled by the shaft end to the elongated base member at the first end and contacting a training surface at the toe end;

at least one support member extending from the elongated base member to rest on the training surface at the second end of the elongated base member;

the at least one stick member having an angle from about 0-degrees to about 180-degrees with respect to the elongated base member; and wherein the at least one stick member and the at least one support member permit a passage of a projectile thereunder.

2. The sport training apparatus of claim 1, wherein slot located on the first end for receiving a first set of the at least one stick member; a second slot located on the second end for receiving a second set of the at least one stick member.

3. The sport training apparatus of claim 2, wherein the pair of stick members are about 180-degrees with respect to each other.

4. The sport training apparatus of claim 2, wherein the at least one stick member comprises an insertion member for inserting into the first slot or the second slot of the base member.

5. The sport training apparatus of claim 4, wherein the at least one stick member further comprises a shaft on the shaft end coupled to the insertion member forming the angle.

6. The sport training apparatus of claim 5, wherein the at least one stick member comprises a horizontal leg coupled at an end to the shaft and another end coupled to a bow member connecting with a toe member at the toe end that contacts the training surface.

7. The sport training apparatus of claim 6, wherein the horizontal leg has an angle of approximately 90-degrees with respect to the shaft.

8. The sport training apparatus of claim 7, wherein the bow member extends upward from the toe member between approximately 20-degrees to approximately 30-degrees.

9. The sport training apparatus of claim 2, wherein the elongated base member comprises a wider portion that tapers toward the first second end; at least a portion of the wider portion rests on the training surface for prohibiting the projectile to pass.

10. The sport training apparatus of claim 1, wherein the at least one stick member comprises a first stick set and a second stick set.

11. The sport training apparatus of claim 10, wherein the first stick set is a pair of stick members and the second stick set is either a pair of stick members or a single stick member.

12. The sport training apparatus of claim 11, wherein each pair of the stick members is angled toward a center of the elongated base member or away from the center of the elongated base member.

13. The sport training apparatus of claim 11, wherein the angle is approximately 135-degrees from each of the pair of stick members.

14. The sport training apparatus of claim 10, wherein the pair of stick members are about 180-degrees with respect to each other.

15. The sport training apparatus of claim 3, wherein both the first stick set and the second stick set have a same value of the angle.

16. The sport training apparatus of claim 1, wherein the angle is an obtuse angle.

17. The sport training apparatus of claim 1, wherein the angle is an acute angle.

18. The sport training apparatus of claim 1, wherein the at least one support member comprises a pair of support members; one of the pair of support members is located under the first end and the other one of the pair of support members is located under the second end of the elongate base member.

19. The sport training apparatus of claim 1, wherein the at least one support member is triangular-shaped or disc-shaped.

20. The sport training apparatus of claim 1, wherein the elongated base member comprises telescoping member coupled to the elongated base member to extend a length of the elongated base member in a longitudinal direction.

21. The sport training apparatus of claim 19, wherein the telescoping member is sized to be received in the elongated base member.

22. A sport training apparatus comprising:

an elongated base member with a first end and a second end;

at least one stick member with a toe end and a shaft end; the at least one stick member removably coupled by the shaft end to the elongated base member at the first end and contacting a training surface at the toe end;

at least one support member extending from the elongated base member to rest on a training surface at the second end;

the at least one stick member having an angle from about 0-degrees to about 180-degrees with respect to the elongated base member;

a first slot located on the first end of the elongate base member for receiving a first set of the at least one stick member;

a second slot located on the second end of the elongate base member for receiving a second set of the at least one stick member;

the at least one stick member comprises an insertion member for inserting into the first slot or the second slot of the elongated base member;

the at least one stick member further comprises a shaft at the shaft end coupled to the insertion member forming the angle;

the at least one stick member and the at least one support member permit a passage of a projectile thereunder; and wherein the at least one stick member comprises a horizontal leg coupled at an end to the shaft and another end coupled to a bow member connecting with a toe member at the toe end that contacts the training surface.

23. The sport training apparatus of claim 22, wherein the horizontal leg has an angle of approximately 90-degrees with respect to the shaft.

24. The sport training apparatus of claim 23, wherein the bow member extends upward from the toe member between approximately 20-degrees to approximately 30-degrees.

25. The sport training apparatus of claim 22, wherein the first set is a pair of stick members and the second set is a single stick member.

26. The sport training apparatus of claim 25, wherein each pair of the stick members is angled toward a center of the elongated base member or away from the center of the elongated base member.

27. The sport training apparatus of claim 25, wherein the pair of stick members are about 180-degrees with respect to each other.

28. The sport training apparatus of claim 22, wherein the first set is a pair of stick members and the second set is a pair of stick members.

29. The sport training apparatus of claim 28, wherein the angle is approximately 135-degrees from each of the pair of stick members.

30. The sport training apparatus of claim 22, wherein the angle is an obtuse angle.

31. The sport training apparatus of claim 22, wherein the angle is an acute angle.

32. The sport training apparatus of claim 22, wherein the pair of stick members are about 180-degrees with respect to each other.

33. The sport training apparatus of claim 22, wherein both the first set of the at least one stick member and the second set of the at least one stick member have a same value of the angle.

34. The sport training apparatus of claim 22, wherein the at least one stick member comprises an insertion member for inserting into the first slot or the second slot of the base member.

35. The sport training apparatus of claim 22, wherein the at least one support member comprises a pair of support members; one of the pair of support members is located under the first end and the other one of the pair of support members is located under the second end of the elongate base member.

36. The sport training apparatus of claim 35, wherein the telescoping member is sized to be received in the elongated base member.

37. The sport training apparatus of claim 22, wherein the at least one support member is triangular-shaped or disc-shaped.

38. The sport training apparatus of claim 22, wherein the elongated base member comprises telescoping member coupled to the elongated base member to extend a length of the elongated base member in a longitudinal direction.

39. The sport training apparatus of claim 22, wherein the elongated base member comprises a wider portion that tapers toward the second end; at least a portion of the wider portion rests on the training surface for prohibiting the projectile to pass.

* * * * *